US007341685B2

(12) United States Patent
Hamilton et al.

(10) Patent No.: US 7,341,685 B2
(45) **Date of Patent: *Mar. 11, 2008**

(54) BLOCK FORMING METHOD

(75) Inventors: Stanley W. Hamilton, Plymouth, MN (US); Thomas J. Brion, Monticello, MN (US); Anders M. Ruikka, Zimmerman, MN (US); Lawrence J. Ebert, Zimmerman, MN (US); James M. Barthel, Coon Rapids, MN (US)

(73) Assignee: Recon Wall Systems, Inc., Minneapolis, MN (US)

( * ) Notice: Subject to any disclaimer, the term of this patent is extended or adjusted under 35 U.S.C. 154(b) by 74 days.

This patent is subject to a terminal disclaimer.

(21) Appl. No.: 10/422,073

(22) Filed: Apr. 23, 2003

(65) Prior Publication Data

US 2004/0026601 A1 Feb. 12, 2004

Related U.S. Application Data

(60) Provisional application No. 60/377,258, filed on May 2, 2002.

(51) Int. Cl.

| | |
|---|---|
| ***B28B 1/00*** | (2006.01) |
| ***B28B 1/14*** | (2006.01) |
| *E04B 2/02* | (2006.01) |
| *E04B 7/00* | (2006.01) |
| *E04C 1/00* | (2006.01) |
| *E04C 1/39* | (2006.01) |

(52) U.S. Cl. ..... 264/219; 264/333

(58) Field of Classification Search ..... 264/333, 264/219; 249/62, 186

See application file for complete search history.

(56) References Cited

U.S. PATENT DOCUMENTS

| | | | | |
|---|---|---|---|---|
| 770,677 A | | 9/1904 | Cuatt | |
| 776,137 A | | 11/1904 | Jackson | |
| 788,955 A | | 5/1905 | Shone | |
| 795,900 A | * | 8/1905 | Doughty | 249/146 |
| 1,332,246 A | | 3/1920 | Coates | |
| 1,368,231 A | * | 2/1921 | Atwood | 425/409 |
| 1,380,341 A | * | 6/1921 | Ashmore | 404/47 |

(Continued)

FOREIGN PATENT DOCUMENTS

| | | |
|---|---|---|
| CA | 1 210 249 | 8/1986 |

(Continued)

OTHER PUBLICATIONS

Frederick C. Mish, Webster's Ninth New Collegiate Dictionary, Merriam-Webster, Inc., p. 1110.*

(Continued)

*Primary Examiner*—Christina Johnson
*Assistant Examiner*—Patrick Butler
(74) *Attorney, Agent, or Firm*—Merchant & Gould P.C.

(57) ABSTRACT

A block forming apparatus is provided. The block forming apparatus includes first and second jackets detachably secured to a base pallet. The first and second jackets may be removed from the base pallet during the curing period of a block for use with a second base pallet. A transport is provided for removing and transporting the first and second jackets. A method of manufacturing concrete blocks with the block forming apparatus is also provided.

11 Claims, 26 Drawing Sheets

U.S. PATENT DOCUMENTS

| | | | | | |
|---|---|---|---|---|---|
| 1,382,824 | A | * | 6/1921 | Cutler | 52/600 |
| 1,489,979 | A | * | 4/1924 | Cahill | 264/256 |
| 1,581,797 | A | | 4/1926 | Fey | |
| 1,584,920 | A | | 5/1926 | Flint et al. | |
| 2,121,450 | A | | 6/1938 | Sentrop | |
| 2,221,125 | A | * | 11/1940 | Ball | 249/213 |
| 2,582,161 | A | * | 1/1952 | Randall | 425/424 |
| 2,903,777 | A | * | 9/1959 | Mitchell | 425/439 |
| 2,953,469 | A | | 9/1960 | Fox | |
| 3,058,164 | A | | 10/1962 | Rowe | |
| 3,546,052 | A | | 12/1970 | McNamara | |
| 3,734,657 | A | * | 5/1973 | Reed | 425/62 |
| 3,789,776 | A | * | 2/1974 | Funkey | 105/377.11 |
| 3,966,166 | A | | 6/1976 | Elliott | |
| 4,043,826 | A | | 8/1977 | Hum | |
| 4,070,849 | A | | 1/1978 | DiGiacomo | |
| 4,197,684 | A | | 4/1980 | Johnson | |
| 4,331,734 | A | | 5/1982 | Stegmeier | |
| 4,372,906 | A | * | 2/1983 | del Valle | 264/256 |
| 4,490,075 | A | | 12/1984 | Risi et al. | |
| 4,500,275 | A | | 2/1985 | Ruhl | |
| D280,024 | S | | 8/1985 | Risi et al. | |
| 4,815,897 | A | | 3/1989 | Risi et al. | |
| 4,819,874 | A | | 4/1989 | Geiger | |
| 4,847,026 | A | | 7/1989 | Jarboe et al. | |
| 4,909,010 | A | | 3/1990 | Gravier | |
| 4,960,622 | A | | 10/1990 | Jarboe et al. | |
| 5,273,251 | A | | 12/1993 | Badstieber | |
| 5,406,054 | A | | 4/1995 | Chirdon | |
| 5,435,949 | A | | 7/1995 | Hwang | |
| 5,484,236 | A | | 1/1996 | Gravier | |
| 5,487,526 | A | | 1/1996 | Hupp | |
| D370,272 | S | | 5/1996 | Risi et al. | |
| 5,622,456 | A | | 4/1997 | Risi et al. | |
| 5,623,797 | A | | 4/1997 | Gravier et al. | |
| 5,637,236 | A | | 6/1997 | Lowe | |
| 5,667,200 | A | | 9/1997 | Kelley, Jr. | |
| 5,817,248 | A | | 10/1998 | Forlini | |
| D411,315 | S | | 6/1999 | Bott | |
| 5,935,317 | A | | 8/1999 | Soroushian et al. | |
| 5,937,601 | A | | 8/1999 | McDonald | |
| 5,943,234 | A | | 8/1999 | Martinez et al. | |
| 6,000,183 | A | | 12/1999 | Newman | |
| 6,032,488 | A | | 3/2000 | Deruyter et al. | |
| 6,035,583 | A | | 3/2000 | Papke | |
| 6,082,067 | A | | 7/2000 | Bott | |
| 6,557,818 | B2 | | 5/2003 | Manthci | |
| 6,620,364 | B2 | | 9/2003 | Gresser et al. | |
| 2001/0019684 | A1 | | 9/2001 | Manthei et al. | |

FOREIGN PATENT DOCUMENTS

| | | |
|---|---|---|
| FR | 2.220.990 | 10/1974 |

OTHER PUBLICATIONS

Disclosure of "Reduced Weight Slip Cast Concrete Retaining Wall Block" provided to applicant by Redi-Rock International; 9 pages; (known to Applicant as of Oct. 15, 2001).

Cleco Mfg. brochure, Wallingford, CT, 2 pages (Date: known to Applicant prior to the filing date of the present application).

International Pipe Machinery Corp. brochure, Quinn Wet Cast Septic Tank Form, 1 page pages (Date: known to Applicant prior to the filing date of the present application).

Spillman; Columbus, Ohio, brochure, 2 pages (Date: known to Applicant prior to the filing date of the present application).

Elk River Machine Co., Photographs of Retaining Walls, entitled "Retaining Wall Form", 4 pages (Date: known to Applicant prior to the filing date of the present application).

Rempel Bros. of Canada brochure, 1 page (1999).

Rempel Bros. Concrete Ltd., http://www.rempelbros.com/what's_new/content/mainb.htm, 1 page (Date: known to Applicant prior to the filing date of the present application).

Armcon Ltd. brochure, LocBloc™ Retaining Wall Block, http://www.armcon.com/frames.html, 1 page, (Date: known to Applicant prior to the filing date of the present application).

Allan Block brochure, 1 page, and photos, (1994).

Concrete Gabions brochure, 2 pages (Date: known to Applicant prior to the filing date of the present application).

Lok Blok Retaining Systems, http://www.lokblok.co.za/, 1 page (Date: known to Applicant prior to the filing date of the present application).

Loffelstein® brochure, 2 pages (1989).

American Redi-Bloc™ brochure, 2 pages (2000).

Risi Stone Systems brochure, 2 pages (1994).

Unilock brochure, http://www.unilock.com/walls/index.html, 2 pages (Date: known to Applicant prior to the filing date of the present application).

PISA II Retaining Wall System, http://www.risistone.com/systems/p2/frames/p2ctx.htm, 5 pages (Date: known to Applicant prior to the filing date of the present application).

United Lock-Block™ Ltd., http://www.unitedlockblock.com/products.htm, 2 pages (Date: known to Applicant prior to the filing date of the present application).

OCTA BLOC™ Precast Block Systems & Materials, http://www.rempelbros.com/products&services/content/precast.htm, 2 pages (Date: known to Applicant prior to the filing date of the present application).

Cleco Mfg., Inc. MCX 200 Showguide, 2 pages (2000).

Del Zotto Products, Incorporated advertisement, *The Concrete Producer*, p. 63 (2000).

Octa Bloc™ Presentations to Cernstone by Rempel Bros. Concrete Ltd., Orlando FL, 39 pgs (2000).

Anchor Wall Systems brochure, 2 pages (1993).

Reinforced Earth® brochure, 4 pages (1995).

Interlock Concrete Products Inc. brochure, 3 pages (1994).

American Redi-Bloc Manufacturing; http://www.americanredibloc.com, 12 pages (Date: known to Applicant prior to the filing date of the present application).

Design Pro "TerraCrete™" Landscape Block Form System brochure, 1 page (Date: known to Applicant prior to the filing date of the present application).

Actual Drawing, The Neel Company, "T-Wall Form Liner Adapter" (1996).

Actual Drawing, Spillman Company , "Beam Forms", (1986).

National Concrete Masonary Assn., "Segmental Retaining Walls", Herndon, VA, 2nd Edition (Date: known to Applicant prior to the filing date of the present application).

Avon Manufacturing Company, Inc., "Speed-Strip Septic Tank Molds," sales brochure, 4 pages (Feb. 19, 1964).

Roll-Away Form brochure, Redi-Rock International; and Rollaway Purchase Agreement, Redi-Rock International; 2 pages; (Purchase Agreement date Feb. 6, 2001).

* cited by examiner

Detail A

BLOCK FORMING METHOD

CROSS-REFERENCE TO RELATED APPLICATIONS

This application claims the benefit of U.S. provisional application, Ser. No. 60/377,258, filed May 2, 2002, which application is herein incorporated by reference.

TECHNICAL FIELD

This disclosure relates generally to methods and devices for making formed materials. More particularly, this disclosure relates to a block forming apparatus for making concrete blocks.

BACKGROUND

Blocks, such as retaining wall blocks, are frequently used in landscaping. Some typical blocks include tongue and groove configurations that easily stack to provide a sturdy wall. The blocks are manufactured in a variety of sizes to accommodate various landscaping applications and designs. The blocks may be manufactured from a variety of materials.

One such material includes ready mix concrete. Often excess ready mix concrete is returned from commercial or residential construction projects and dumped on the ground for disposal purposes. One solution in addressing this waste problem is to use the excess material in the manufacture of retaining blocks.

A formed block, apparatus and method of making the block using returned ready mixed concrete is disclosed in U.S. application Ser. No. 09/788,836, which is herein incorporated by reference. The method of manufacturing discloses an advantageous use for returned concrete. The returned concrete is poured into a block forming device to form large blocks for use in landscaping applications. The forming device includes four hinged doors secured to a bottom platform. Concrete is poured into the cavity formed by the doors and bottom platform. After the concrete cures for about 10-14 hours, the doors are pivoted outward and the hardened block is lifted from the device. In this arrangement, only one block can be produced within the curing time period of 10-14 hours.

Improvement has been sought with respect to such forming devices and methods of manufacturing of these large retaining blocks, generally to better accommodate production quantity and efficiency, and reduce the equipment cost associated with increasing production quantity.

SUMMARY

The present invention relates to a concrete block forming apparatus having a base support, a liner received within the base support and first and second jackets. The liner and first and second jackets define a molding cavity into which a moldable concrete is poured.

One aspect of the present invention relates to the detachable mounting structure of the first and second jackets. Another aspect relates to a transport device that attaches to a jacket at a first attachment location and is adapted to laterally slide the jacket from a partially cured block. The transport device may then be attached to the jacket at a second attachment location to transport the jacket to a second base pallet. Yet another aspect of the invention relates to a method of manufacturing concrete blocks using the detachable first and second jackets interchangeably with different base pallets.

DETAILED DESCRIPTION

With reference now to the various figures in which identical elements are numbered identically throughout, a description of various exemplary aspects of the present invention will now be provided.

In general, this disclosure describes improvements over the apparatus and methods of manufacturing retaining blocks of the U.S. application Ser. No. 09/788,836. While the apparatus and methods described in U.S. application Ser. No. 09/788,836 are improvements over the old methods and constructions of the prior art, there can still be further improvements. This disclosure concerns many such improvements.

For example, the apparatus disclosed in U.S. applicant Ser. No. 09/788,836 produces one block in the time period required for the block to cure. Block manufacturers desire to produce quantities sufficient to accommodate larger jobs. Because of the time involved in producing a single block, a number of block forming devices is required to produce larger quantities of blocks. The cost to purchase equipment to produce larger quantities of blocks can be considerable.

One improvement herein disclosed relates to an apparatus that increases production rate by permitting the enclosure portions of the block forming apparatus to be removed from the block and base while the block is only partially cured (i.e. 4 hours). Typically, the blocks cannot be removed from the form until the block is fully cured (i.e. 10-14 hours). By providing removable enclosure portions, the partially cured block can remain stationary in the base to continue curing, while the enclosure portions may be transported for use with another base to produce the next block. This permits a manufacturer to produce, for example, 3 blocks per day with one set of enclosure portions and 3 bases.

Blocks

Retaining wall blocks are typically stacked in layers, one on top of the other, to form a retaining wall. The vast types of landscaping applications and locations require different size and shape retaining walls. One example of a retaining block that may be manufactured in accordance with the principles disclosed is illustrated in FIGS. 1 and 2.

Figure 1:
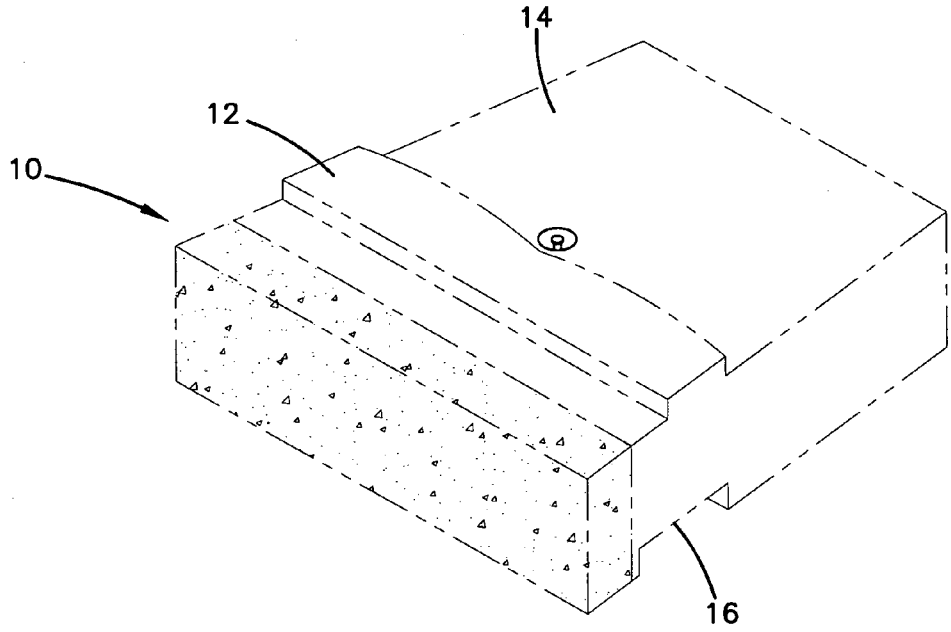
FIG.1 (Prior Art)
FIG. 1 is a top perspective view of a full block manufactured according to the principles disclosed.
Figure 2:
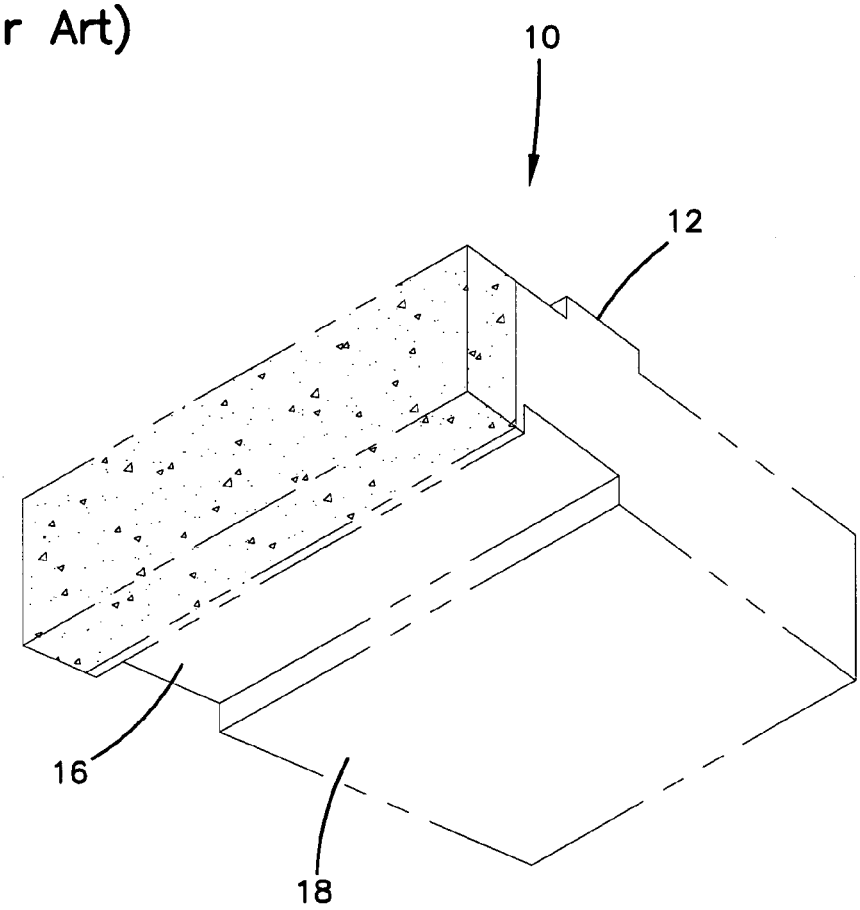
FIG.2 (Prior Art)
FIG. 2 is a bottom perspective view of the full block of FIG. 1.
Figure 6:
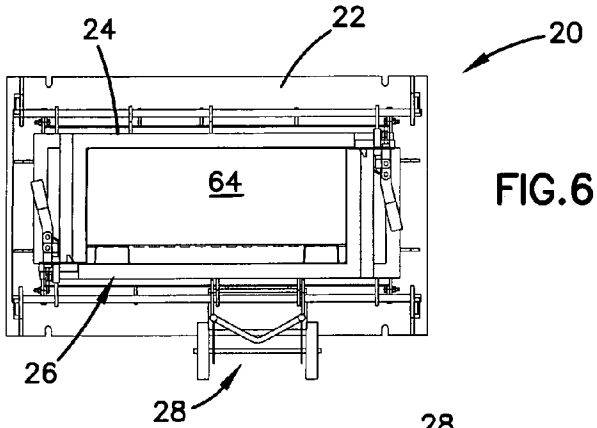
FIG. 6 is a top plan view of the block form apparatus of FIG. 3.
Figure 3:
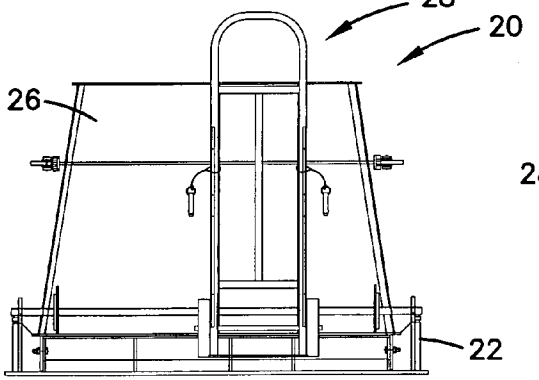
FIG. 3 is a front elevational view of one embodiment of a block forming apparatus for manufacturing full blocks, including a jacket transport, according to the principles disclosed.
Figure 4:
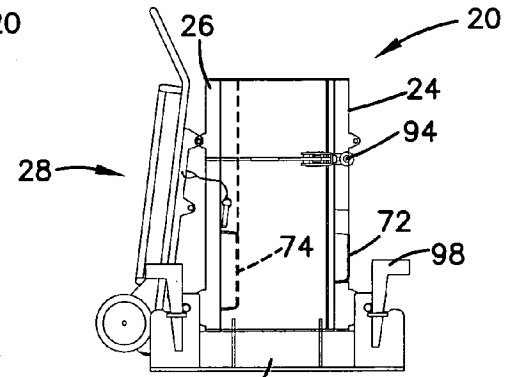
FIG. 4 is a side elevational view of the block forming apparatus of FIG. 3.
Figure 5:
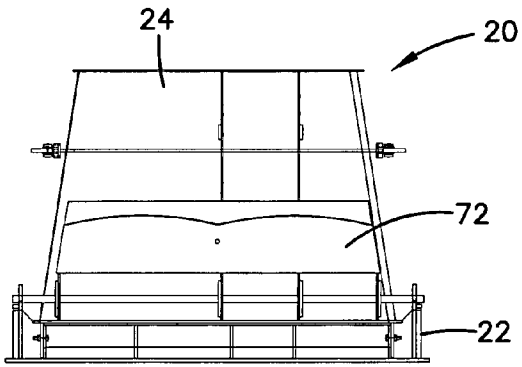
FIG. 5 is a rear elevational view of the block form apparatus of FIG. 3, shown without the jacket transport.

The retaining block of FIGS. 1 and 2 is a full block 10 having a tongue 12 protruding from a top surface 14 of the block. The full block 10 also includes a groove 16 in a bottom surface 18 of the block. The tongue of one block generally corresponds to the groove of another block to provide a stable wall structure.

A retaining wall may include one or more different types of retaining wall blocks. The full block 10 of FIGS. 1 and 2 is illustrated for explanatory purposes only. Other types of blocks, including half blocks, corner blocks and top blocks may be manufactured in accordance with the principles disclosed.

Block Forming Apparatus

FIGS. 3-6 illustrate one embodiment of a block forming apparatus 20 according to the principles disclosed. The block forming apparatus embodiments herein described are not intended to be limited to forming the blocks described above. Further, one possible use of the disclosed apparatus is for utilizing moldable returned concrete such as wetcast concrete. The use of returned concrete is one exemplary use of the block forming apparatus herein disclosed. The block forming apparatus embodiments described are not limited to being used with returned concrete.

The block forming apparatus or block form 20 shown in FIGS. 3-6 generally includes a base support or base pallet 22, first and second enclosure components or jackets 24, 26, and a jacket transport 28. The first and second jackets 24 and 26 detachably mount to the base pallet 22 to form an enclosure into which moldable concrete can be poured.

Figure 13:
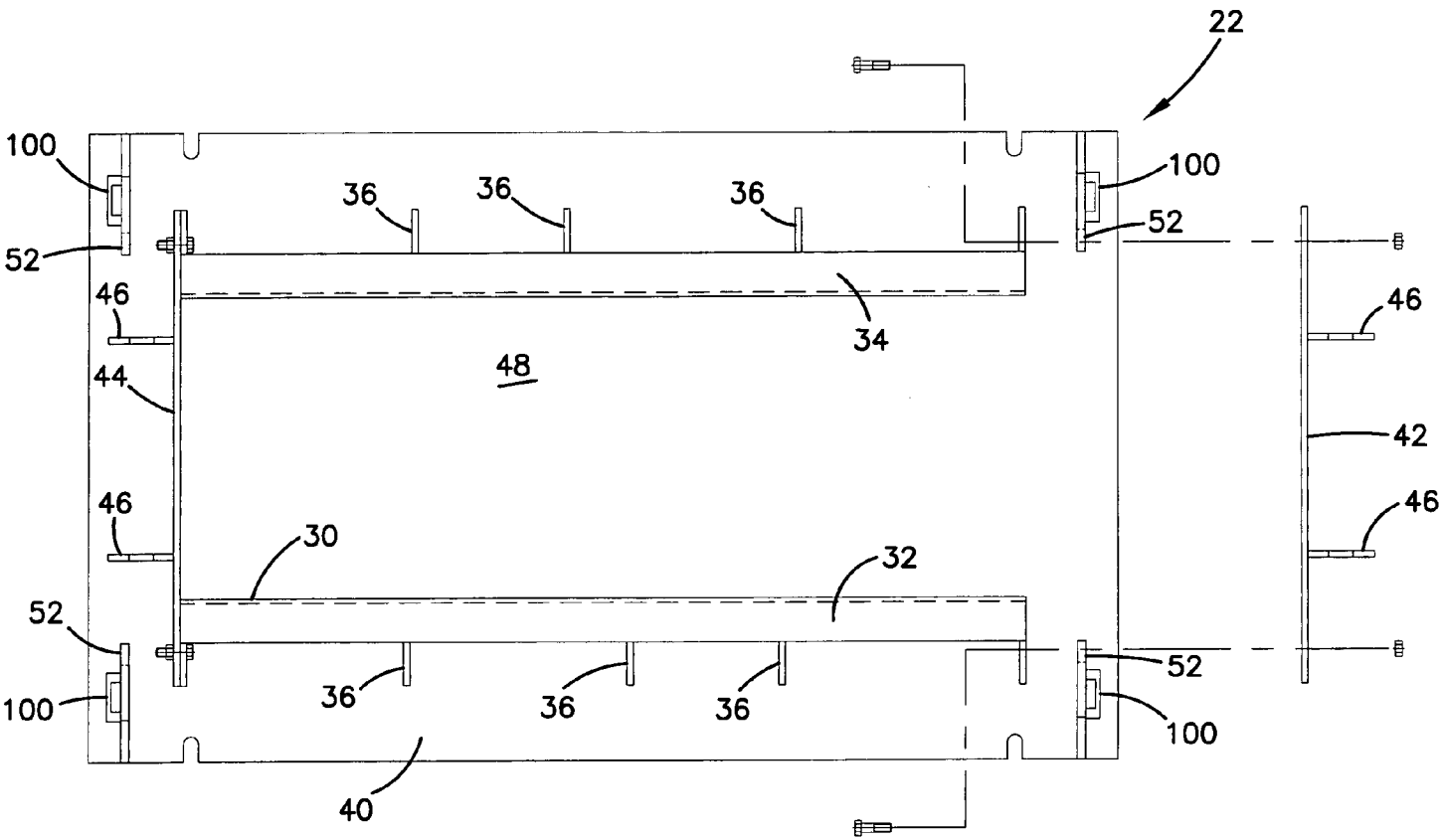
FIG. 13 is a top plan view on one embodiment of a base support of the block forming apparatus of FIG. 3.
Figure 14:
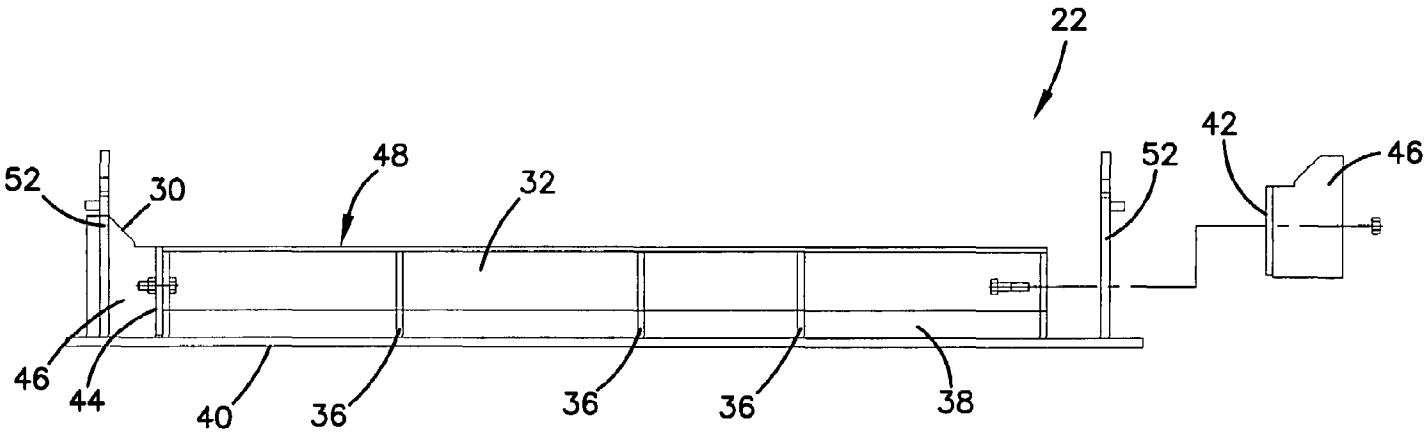
FIG. 14 is a front elevational view of the base support of FIG. 13.
Figure 15:
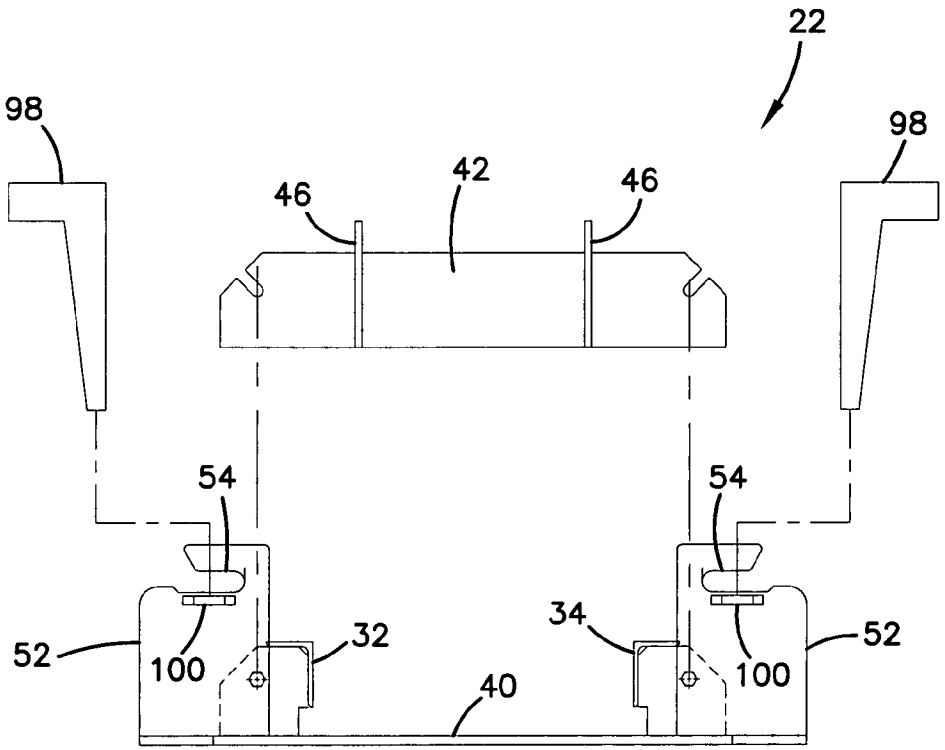
FIG. 15 is an exploded side elevational view of the base support of FIG. 14.

Referring first to FIGS. 13-15, the base pallet 22 of the block form 20 includes a supporting structure 30 that supports the first and second jackets 24, 26. As shown in FIG. 13, the supporting structure 30 of the base pallet 22 includes two parallel beams 32 and 34 supported by offset members 36. The offset members 36 are welded, or secured by other fastening means, to a flat platform 40. End plates 42 and 44 are fastened to the beams 34, 36. The end plates 42, 44 including support fins 46 to provide structural stability to the supporting structure 30 of the base pallet 22. The end plates 42, 44 and beams 32, 34 define a liner receiving area 48 into which a liner 50 (shown in FIG. 16) may be placed or positioned.

The base pallet 22 further includes retaining structures or flanges 52. In the illustrated embodiment, the base pallet includes four flanges 52 located at each of the corners of the base pallet 22. Each of the flanges 52 extends generally perpendicular from the platform 40. The flanges 52 include slots 54 used for securing the jackets 24, 26 to the base pallet 22.

Figure 9:
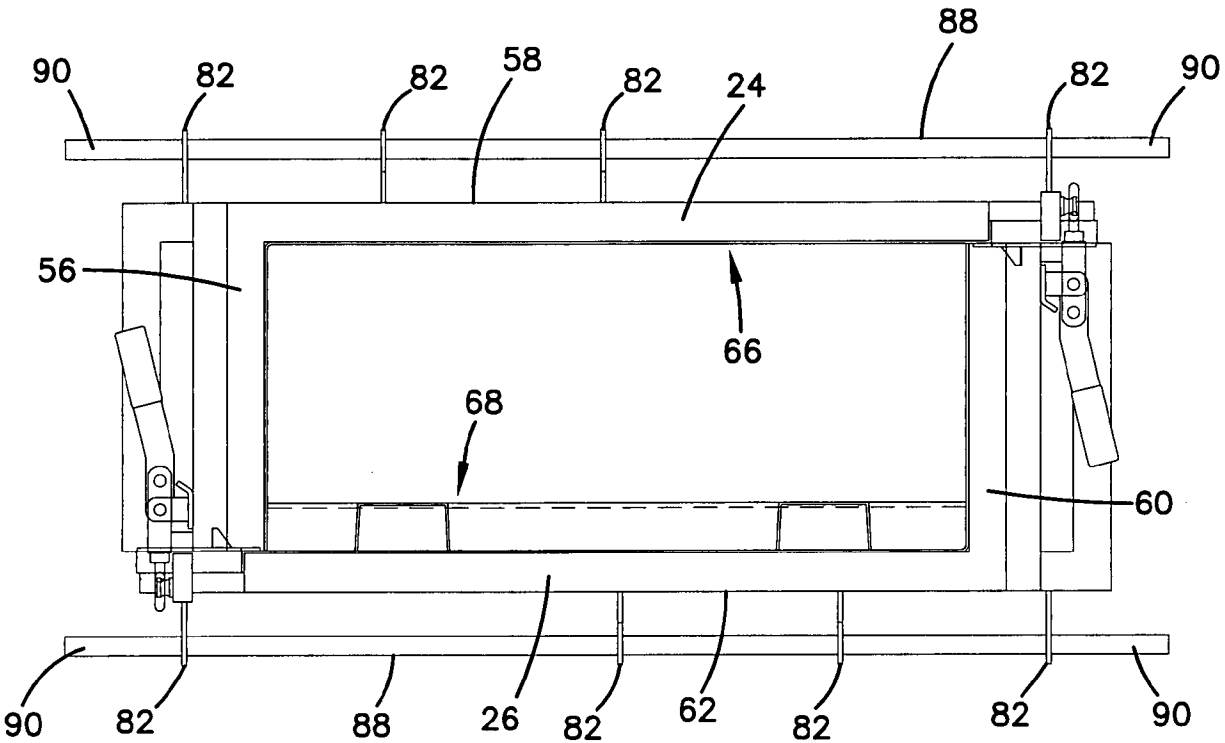
FIG. 9 is top plan view of one embodiment of the jacket components of the block forming apparatus of FIG. 3.
Figure 10:
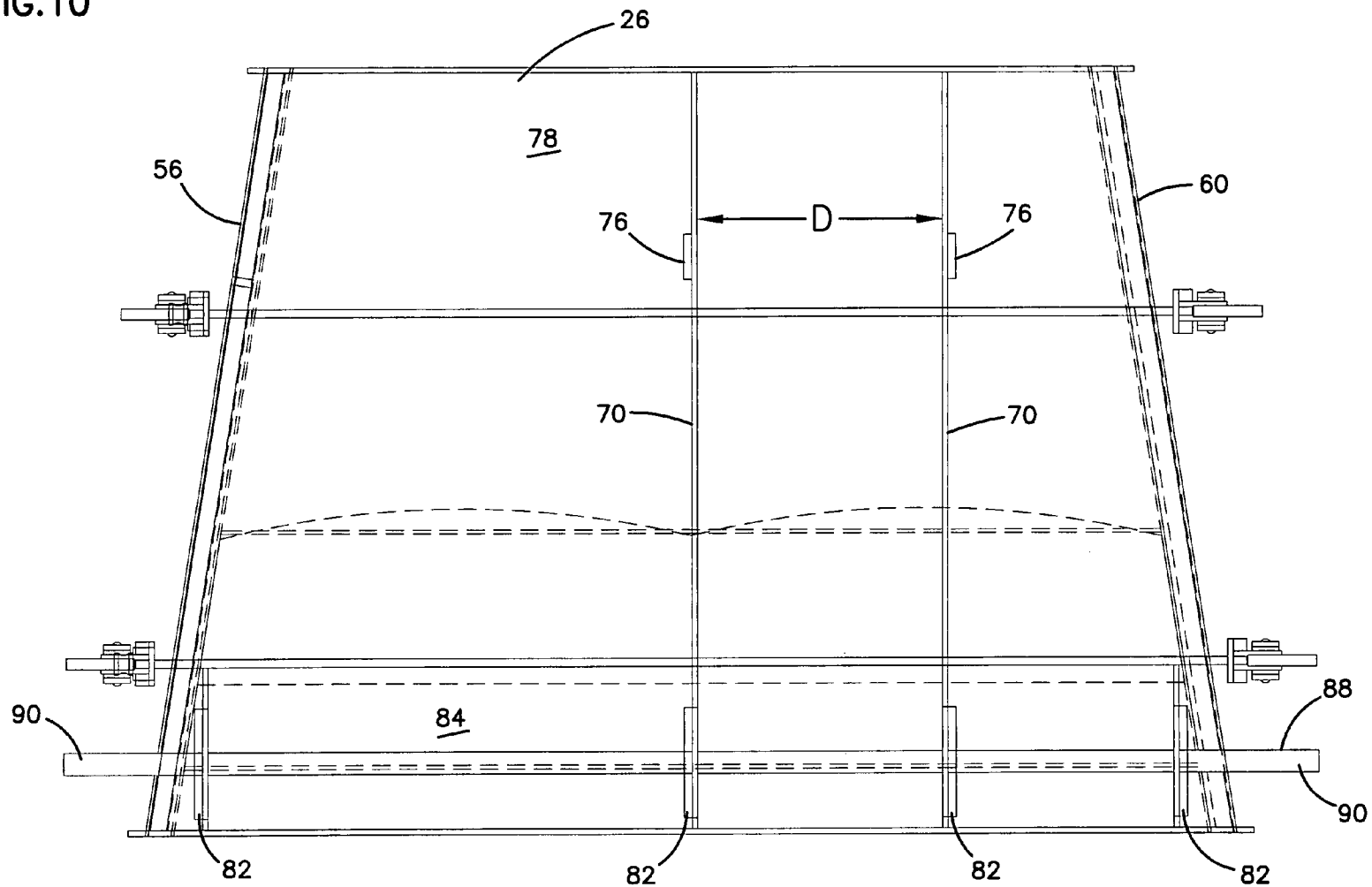
FIG. 10 is a front elevational view of the jacket components of FIG. 9.

Referring now to FIGS. 9-12, each jacket 24 and 26 of the block forming apparatus includes an end member and a side member. As shown in FIG. 9, the first jacket 24 has a first end member 56 joined to a first side member 58. The second jacket 26 has a second end member 60 joined to a second side member 62. The end members 56, 60 are generally shorter than the side members 58 and 62. In the illustrated embodiment, the end and side members of each jacket are generally perpendicular to one another and have an L-shaped configuration.

Each of the jackets 24 and 26 detachably mounts to the base pallet 22. As shown in FIG. 9, the first jacket 24 couples to the base pallet 22 in a position opposite from the second jacket 26. When assembled, the base pallet 22 and the jackets 24 and 26 define an interior molding cavity or enclosure 64 (best shown in FIG. 6) into which moldable concrete is poured. In a preferred embodiment of the block form, the jackets 24, 26 include interior molding surfaces 66, 68. The interior molding surfaces 66 and 68 contact the moldable concrete directly.

In the illustrated embodiment, the molding surfaces are strengthened by two or more gussets 70 (shown in FIG. 10) that extend in a generally vertical orientation. More or fewer gussets than shown in the embodiment may be utilized depending on the weight that the jacket must withstand, which depends upon the amount of moldable concrete used. Furthermore different size and shaped gussets may also be used.

The molding surface of a block form may be shaped in such a way as to create tongue and groove sets on the block being formed. For example, to arrive at the full block 19 illustrated in FIGS. 1, 2 and 8 of this application, the first jacket 24 includes a recession 72 (shown in FIGS. 4, 5 and 10) on the wall of its interior molding surface 66 to result in formation of the tongue 12 in the top surface 14 of the block 10. The second and opposite jacket 26 on the block form 20 includes a protrusion 74 (shown in FIGS. 4 and 11) in the shape of the groove 16 formed on the bottom surface 18 of the block. The recession 72 and the protrusion 74 in the molding surfaces 66, 68 of the jackets 24, 26 can be any shape desired. The block form 20 of this invention is not limited to the formation of the retaining wall blocks described above.

Figure 11:
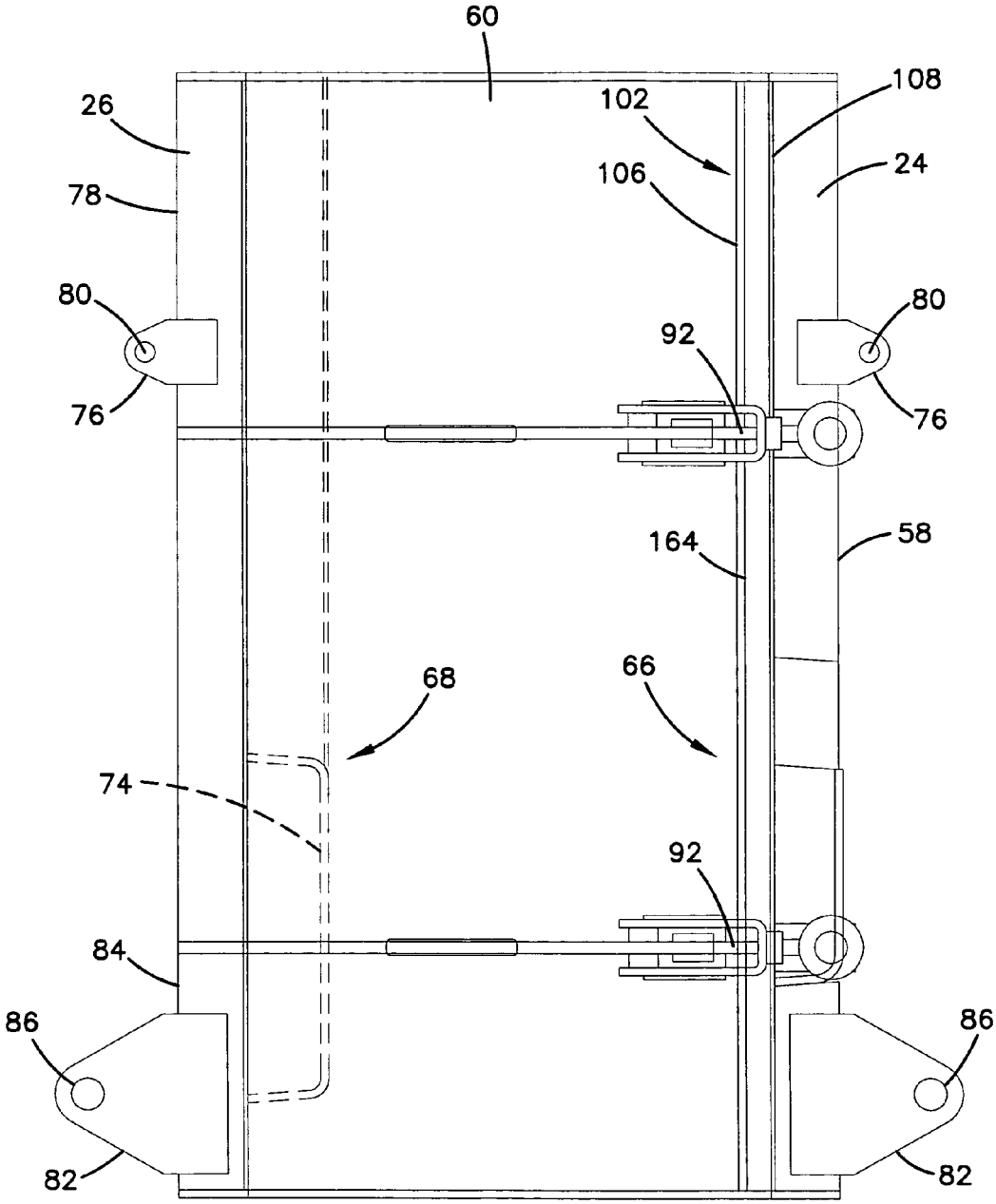
FIG. 11 is a side elevational view of the jacket components of FIG. 10.
Figure 12:
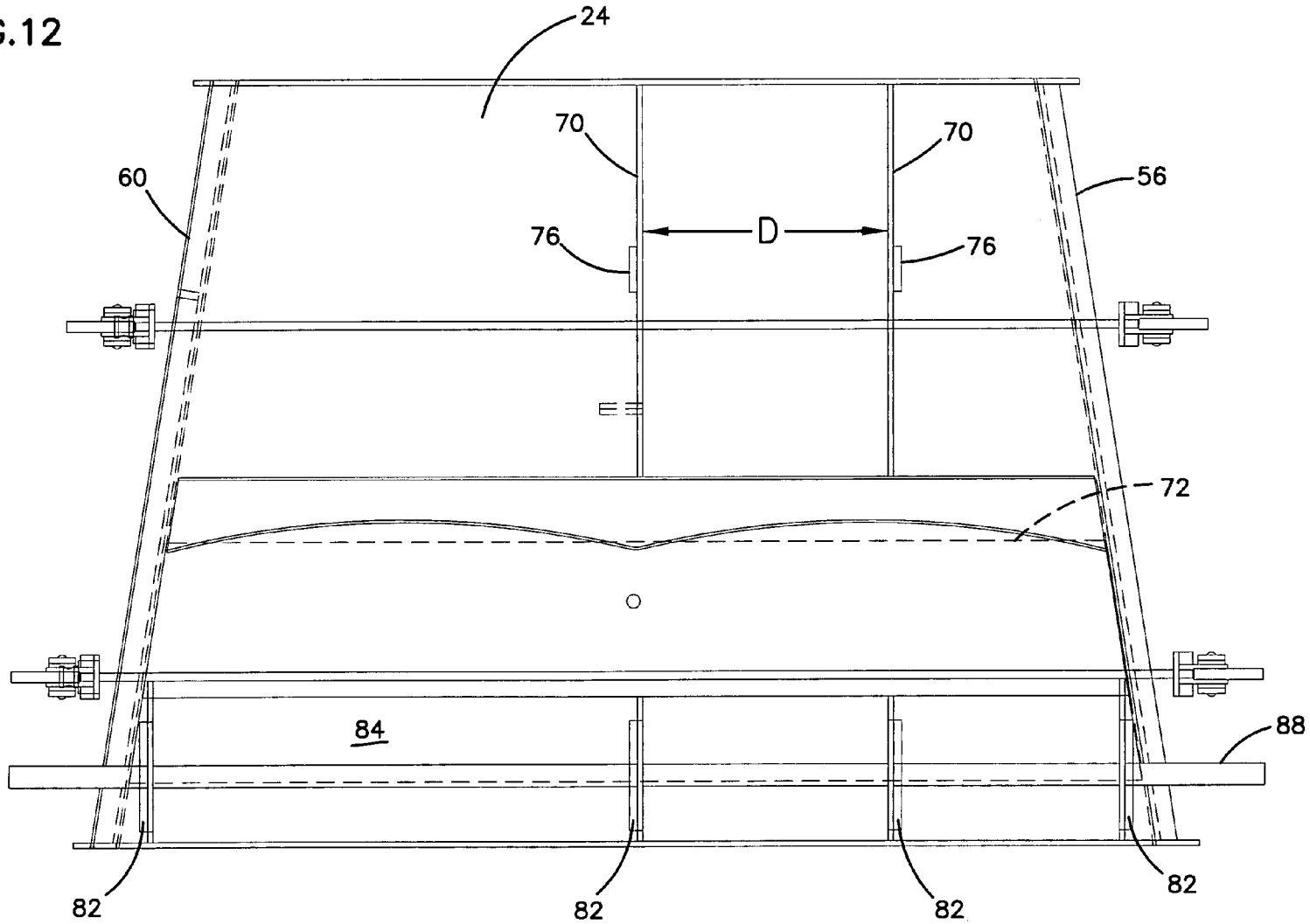
FIG. 12 is a rear elevational view of the jacket components of FIG. 11.

As shown in FIG. 11, each of the jackets 24, 26 includes upper coupling brackets 76 positioned toward an upper region 78 of the jacket 24, 26. The upper brackets 76 are located at a distance D apart from one another and offset from a center of the side of each jacket (see FIG. 12). The upper brackets 76 include holes 80 for coupling with the jacket transport 28 (see FIG. 4), which is described in greater detail hereinafter.

Still referring to FIG. 11, each of the first and second jackets 24, 26 also includes lower brackets 82 positioned at a lower region 84 of the jacket 24, 26. Each of the lower brackets 82 includes a through hole 86 sized to correspond to a securing rod 88 (FIG. 9). In the illustrated embodiment, four lower brackets 82 (FIG. 10) are securely mounted to the side of each jacket. Each securing rod 88 slides through the holes 86 of the lower brackets 82 and couples each of the jackets 24, 26 to the base pallet 22, shown in FIGS. 3-6. In particular, securing rods ends 90 engage the slots 54 of the flanges 52 on each of the corner of the base pallet 22 so that the jacket cannot ride up when the block form is filled with concrete. This connection configuration securely holds the jackets in place while at the same time does not require a user to bolt, fasten or hinge the jackets to the base pallet, thus making placement and removal of the jacket quick and easy. In addition, as will be described herein, the rods 88 are used in cooperation with the jacket transport to remove the jacket from the base pallet and transport the jacket to a different location.

Figure 16:
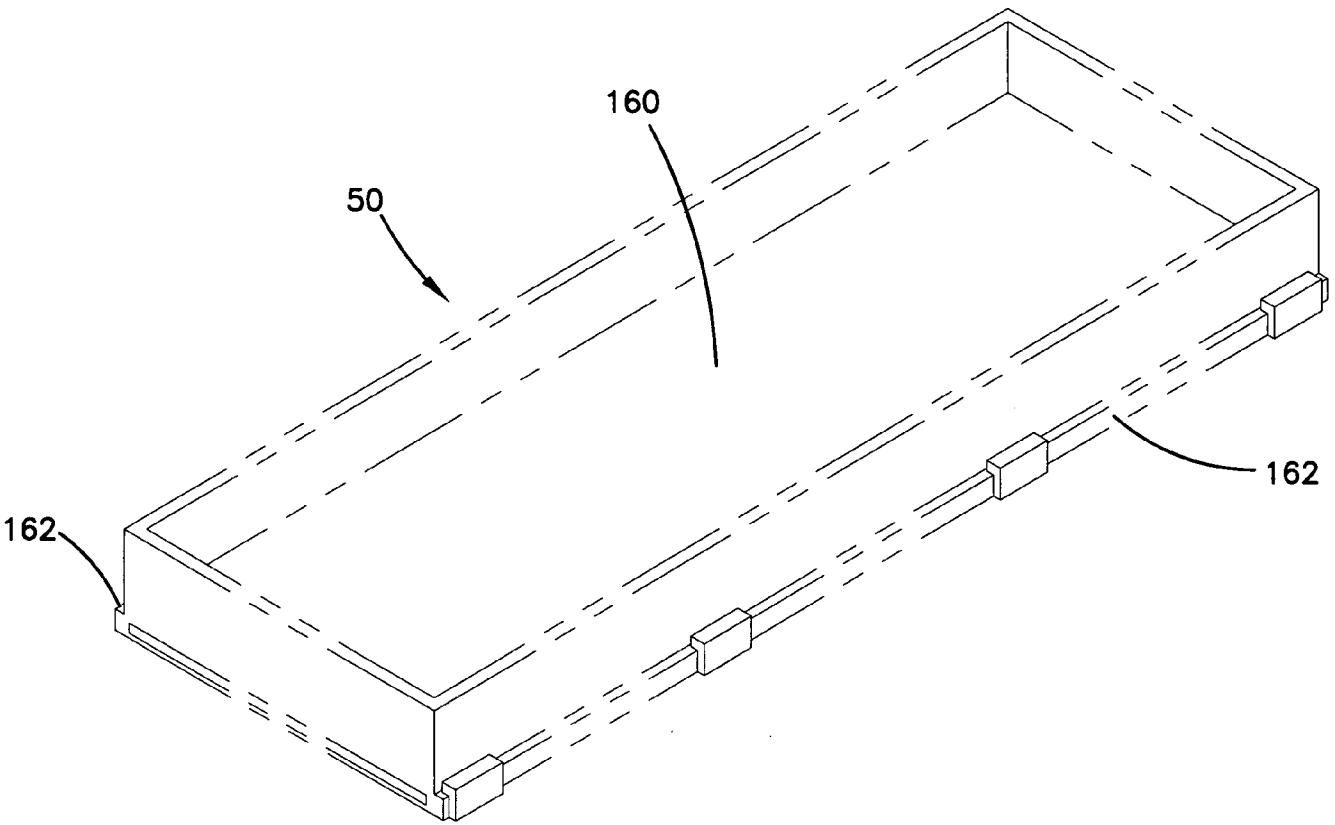
FIG.16 (Prior Art)
FIG. 16 is a front perspective view of one embodiment of a liner used in accordance with the principles disclosed.

In the preferred embodiment, the liner receiving area 48 of the base pallet is sized to receive a form face or liner, such as the liner 50 shown in FIG. 16. A liner is a shaped member for forming the aesthetically pleasing front surface of a block. The liner 50 may have any shape or design that creates the desired front surface of the block being formed. The liner may be utilized to form blocks with one front surface or additional liners may be used to form blocks with multiple front surfaces such as corner blocks. The liner 50 is placed at least partially within the liner receiving area 48 of the base pallet 22.

The liner in accordance with the principles disclosed includes a bottom surface 160 textured to the desired ornamentation. The liner may be made of any material that is capable of being formed into the desired shape and that prevents the moldable concrete from flowing through the base pallet 22 of the block form 20. In one embodiment the liner 50 is made of urethane, which is easily formed to the desired shape.

It is desired to be able to easily remove the liner from the block form for cleaning, repair, or replacement of the liner. As shown in the embodiment of FIG. 16, the liner may include rail or flanges 162 designed for sliding engagement with the base pallet 22. In an alternative embodiment, the liner may include a bolt down structure for example. Of course, the slidable liner makes the method and structure even more attractive and efficient.

Figure 17:
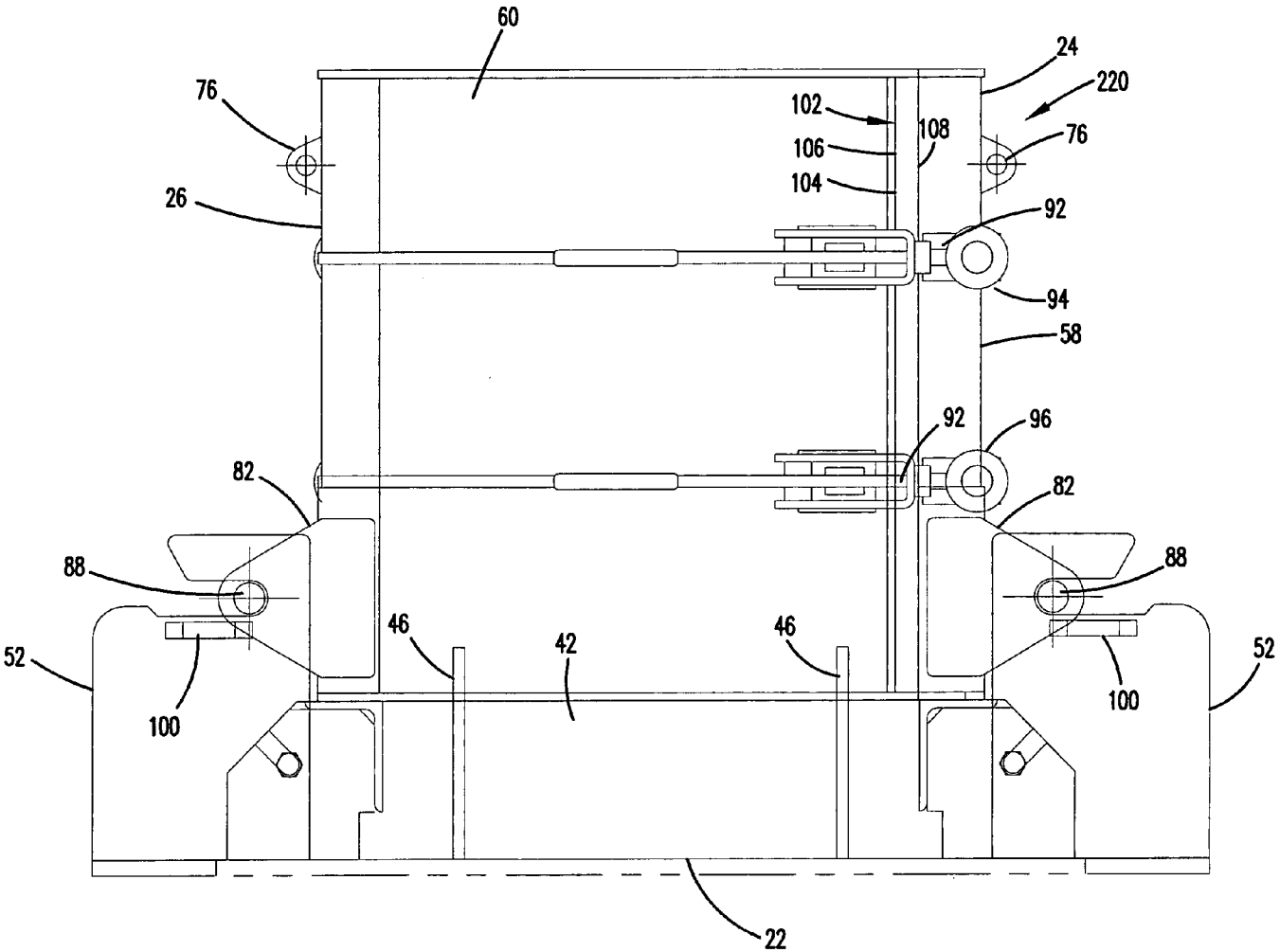
FIG. 17 is a side elevational view of another embodiment of a block forming apparatus having jacket components which form corner blocks.
Figure 18:
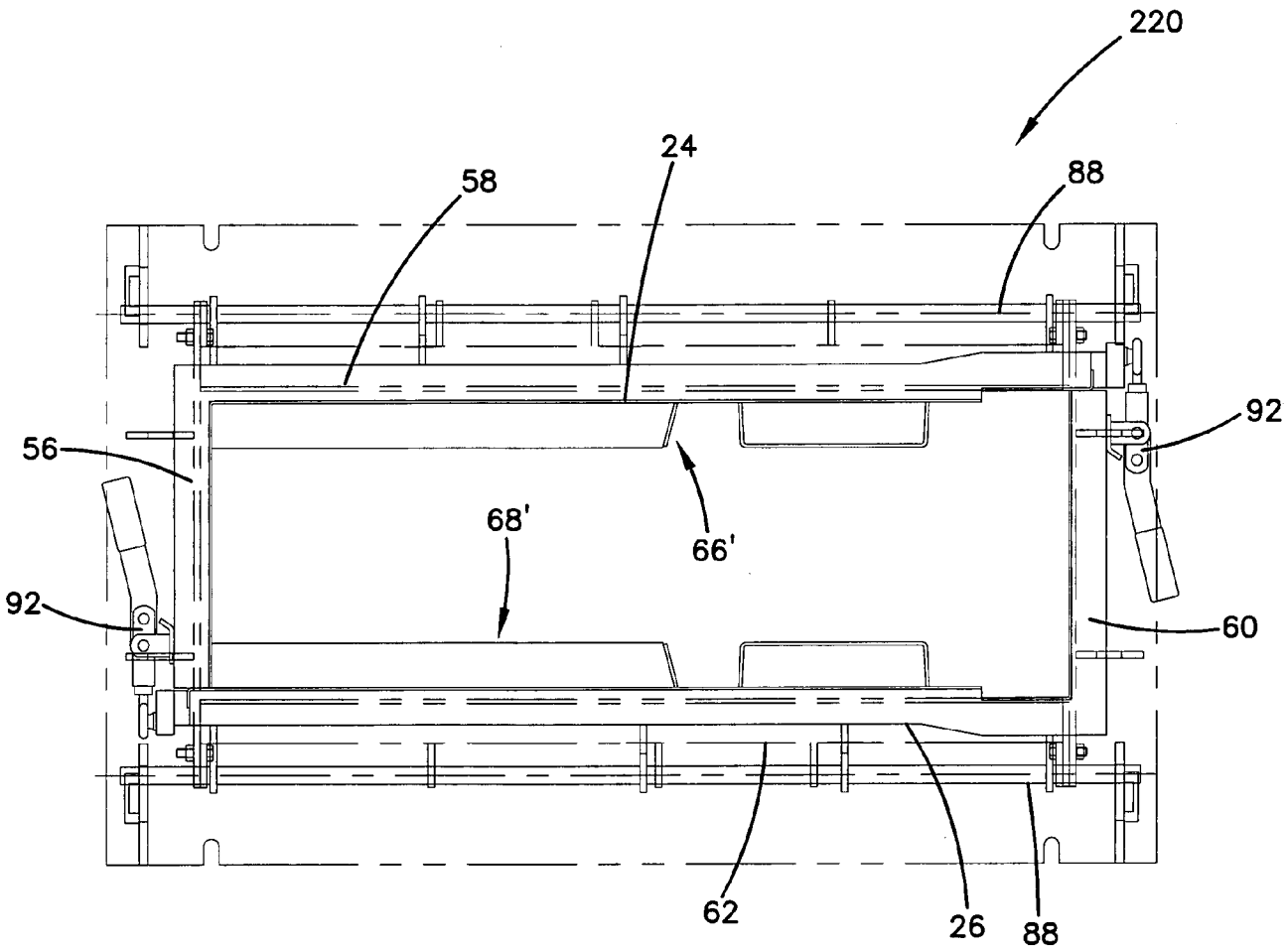
FIG. 18 is a top plan view of the block forming apparatus of FIG. 17.
Figure 19:
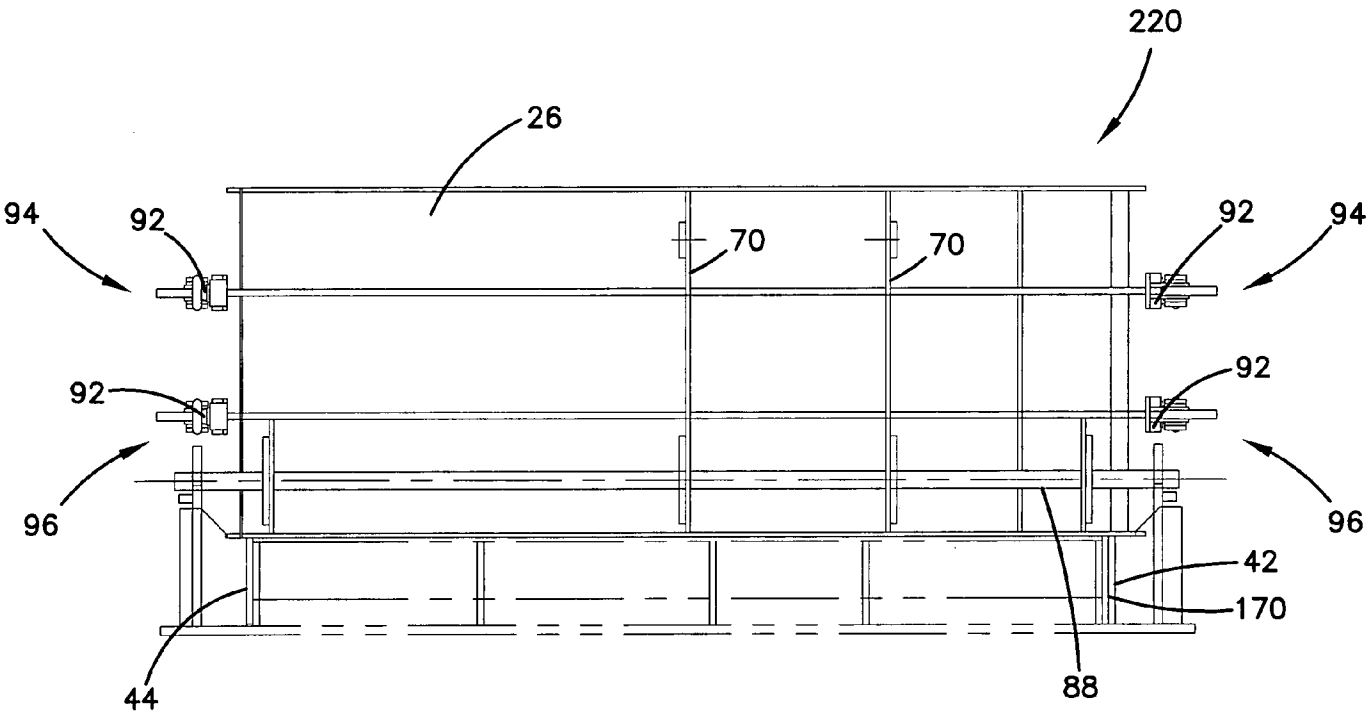
FIG. 19 is a front elevational view of the block forming apparatus of FIG. 18.
Figure 20:
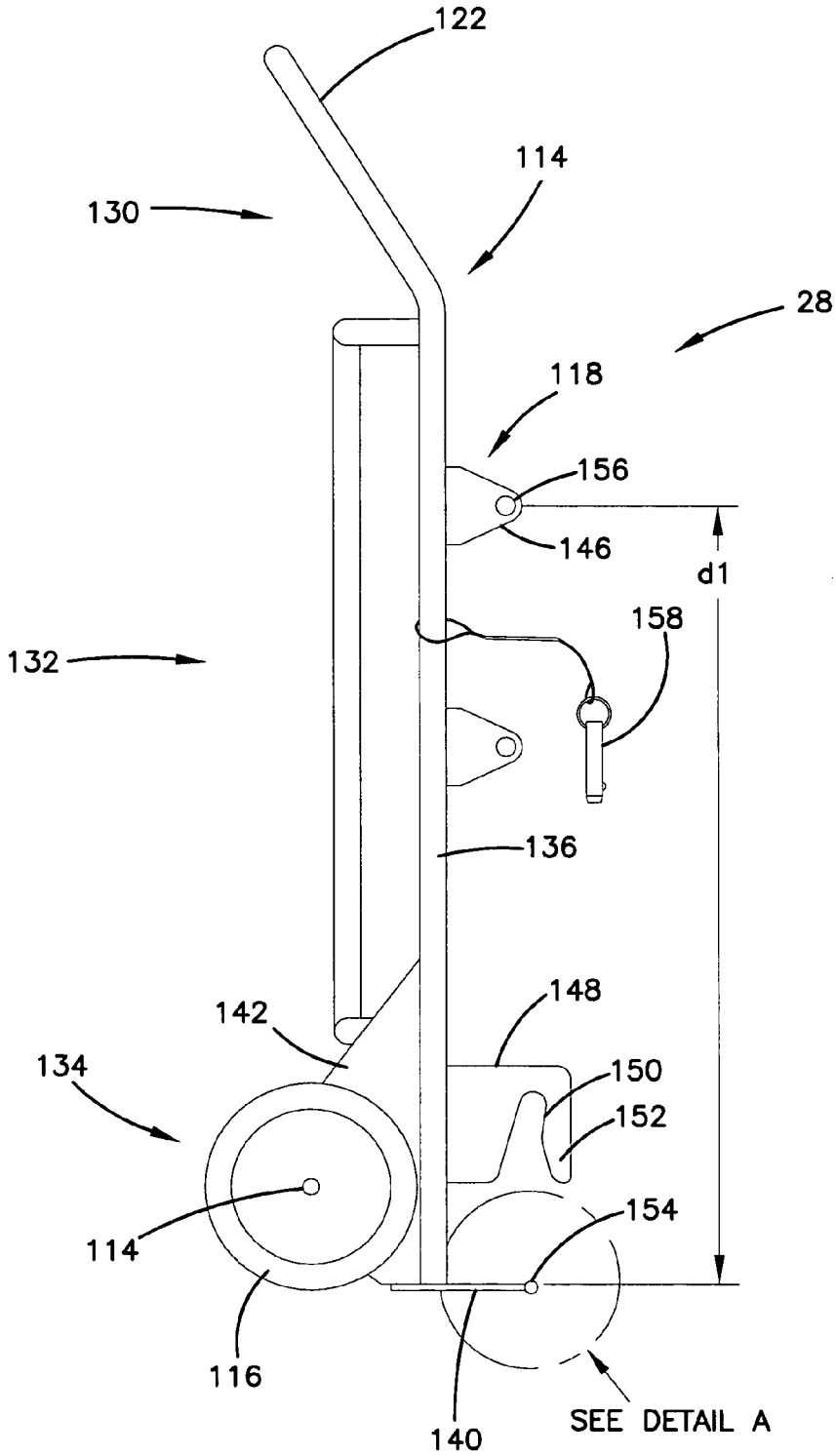
FIG. 20 is a side elevational view of one embodiment of the jacket transport shown in FIG. 3.
Figure 21:
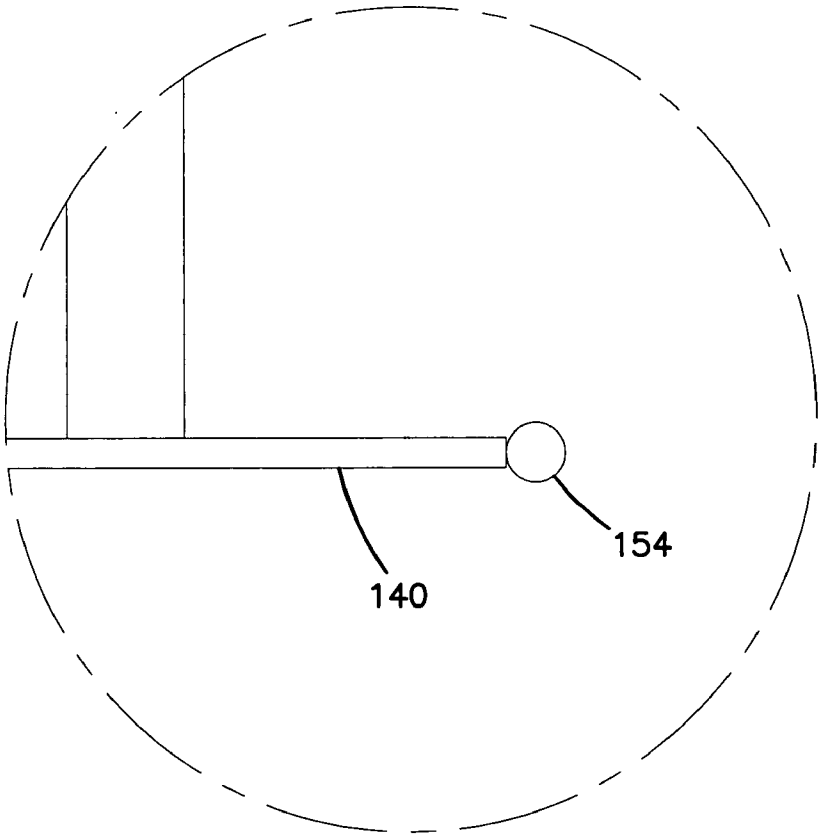
FIG. 21 is an enlarged detail section of FIG. 20.

Referring now to FIGS. 17-19, another embodiment of the block form 220 is shown with jackets 24 and 26 assembled to the base pallet 22. This second embodiment differs slightly from the first full block embodiment by modifying the interior molding surfaces 66' and 68' of the jackets to form corner blocks (not shown). The base pallet 22 is also slightly modified to include a base panel or spacer 170 adjacent the end plate 42 to make a second finished surface of the corner block.

With respect to alternative embodiments disclosed herein, locking mechanisms 92 are provided to securely hold the first and second jackets in their molding position while the moldable concrete is being poured into the block form 20 as well as during the initial curing stage. A locking mechanism is any mechanism that retains the jackets in their positions during these steps.

In the embodiment shown in FIG. 17, the locking mechanisms utilized are upper and lower over-center clamps 94 and 96. In particular, the upper and lower over-center clamps 94 and 96 illustrated are ten-inch Concrete Form Clamps made by Best Metal Clamps. In an alternative embodiment, the locking mechanisms may comprise upper over-center clamp that retain the upper regions 78 of the jackets and wedge pieces 98 (shown in FIG. 15) that retain the lower regions 84 of the jackets.

As shown in FIGS. 13, 15 and 17, the wedge pieces 98 are constructed to slidably fit within wedge brackets 100. The wedge pieces 98 wedge the securing rod 88 in position within the slots 54 of the retaining members 52 to retain the lower regions 84 of the jackets when only an upper over-center clamp 94 is used (see FIG. 4).

In use, a bond sometimes forms between the concrete block and the jackets during the curing process. It is desired to have a pry point at which a crowbar or other similar tool may be inserted into the block form to break the bond and pry open the first and second jackets after the moldable concrete has at least partially cured. As shown in FIGS. 11 and 17, channels 102 are located on each of the sides of the block forms between each of the first and second jackets 24, 26. In particular, a first channel 102 is defined between an edge 106 of the end member 60 of the second jacket 26 and an edge 108 of the side member 58 of the first jacket 24. A second channel (not shown) is defined between an edge of the end member 56 of the first jacket 24 and an edge of the side member 62 of the second jacket 26. In the illustrated embodiment, each of the edges of the end members 56 and 60 includes a lip 164 (shown on edge 106 of the second jacket member 76) that projects outward from the outer surface of the end members.

The channels 102 extend generally along the length of the jackets. In an alternative embodiment, the channel may extend only a portion of the length of the jackets, or be located adjacent only the upper region or the lower region or both regions of the jackets. The jackets of the block form 20 may further include pry locations having reinforcement structures against which a pry tool may be used to separate the jackets and the block.

Referring now to FIGS. 20-23, the jacket transport 28 is used to remove and transport the jackets from the block forming apparatus 20. It is to be understood that this jacket transport 28 can be used in accord with the principles disclosed to remove and transport the jackets from each of the disclosed block forming apparatus embodiments. The jacket transport 28 generally includes a frame 114 having a front side 124, a back side 126, a top region 130, a bottom region 132, and a middle region 134. Wheels 116 are attached to the back side 126 of the frame 114 at the bottom region. The jacket transport also includes upper and lower jacket attachments 118 and 120.

The frame 114 includes a first handle portion 122. The first handle portion 122 is located at the top region 130 of the frame and extends at an angle from main transport frame members 136. The jacket transport 28 further includes a nose plate 140 extending forwardly from the front side of the frame 114 and wheel mount brackets 142 extending backwardly from the backside of the frame 114. The wheels are mounted to a wheel axle 144 that extends through each of the wheel mount brackets. In addition to structurally providing a wheel mounting location, the wheel mount brackets structurally support the frame 114 in carrying the weight of the jackets.

The lower jacket attachments 120 include lower brackets 148 that extend outwardly from the front side 124 of the frame 114. The lower brackets 148 may be welded to the main frame members 136 and include slots 150 defining a hook portion 152 that mounts onto the rod 88 of the jacket. As will be described in greater detail, the nose plate 140 and the slot 150 are configured so that when the slot is hooked onto the rod 88 of a jacket, a trim piece 154 (FIG. 21) contacts the base pallet 22 of the block form 20. This trim piece 154 provides a fulcrum point at which the transport is pivoted away from the block form 20 to laterally move the jacket away from the base pallet 22 and block 10.

The upper jacket attachments 118 include upper brackets 146 that extend outwardly from the front side 124 of the frame 114. The upper brackets 146 are attached to the main frame members 136 at a distance d1 from the nose plate. The distance d1 corresponds to the location of the brackets 76 (shown in FIG. 17) of the jackets 24, 26. Pins 158 attached to the transport are used to couple the upper brackets 146 to the jacket brackets 76 when the slots 150 of the lower brackets 148 of the transport 28 are engaged with the rod 88 of the jacket.

The frame 114 and the wheels 116 are similar to standard dollies known in the industry. It is contemplated that other frame and wheel dolly configuration may be used in accordance with the principles disclosed. In particular, it is contemplated that other frame and wheel configurations may be adapted with upper and lower jacket attachments as disclosed.

It is also contemplated that structural features of the transport may be permanently or detachably mounted to the jackets so that the jacket and its transport mechanism are integral. For example, the jackets may include wheels and a pivoting member that operates in similar fashion as the stand alone transport in laterally removing and moving each jacket.

In use, it is desirable that one person be able to move the jackets from one base pallet to another base pallet without assistance from another person. Such task must also be performed in a safe manner. A method by which one person manufactures a block and moves the two jackets 24, 26 of the block form 20 from a first base pallet to a second base pallet will now be described.

The liner 50 (FIG. 16) is placed within the liner receiving area 48 of the base pallet 22 (FIG. 13). The bottom surface 160 of the liner creates a natural stone texture to the face of the block. The first jacket 24 (FIGS. 6 and 9) is placed upon the base pallet 22 by slidably positioning the ends 90 of the securing rod 88 of the first jacket within the slots 54 of two corner retaining members 52 of the base pallet 22. The second jacket 26 is placed upon the base pallet, opposite the first jacket 24, by slidably positioning the ends of the securing rod 88 of the second jacket within the slots 54 of the opposite two corner retaining members 52.

The upper over-center clamp 94 is engaged to secure the upper regions 78 of the jackets 24, 26. The lower over-center clamp 96 is engaged, or in the alternative wedge pieces 98 are inserted into the wedge brackets 100, to secure the lower regions 84 of the jackets. The liner 50 and the first and second jackets 24 and 26 define the interior molding cavity 64 of the block form 20 into which moldable concrete is then poured to form a concrete block.

The moldable concrete is permitted to set up or cure for approximately four hours. It is contemplated that additives and/or heat can be added to the concrete used to produce the block, thus accelerating the cure time. With such additives it would be possible to increase production of blocks per day.

Once the concrete has partially cured (approximately four hours) the jackets 24,26 may be removed. This is accomplished by use of the jacket transport 28. Each jacket weighs approximately 180 pounds, thus the transport 28 has been adapted to permit a user to safely and easily transport the jacket from base pallet to base pallet.

In removing the jackets 24, 26 from the base pallet 22, a seal or bond which exists after the concrete has initially set up or cured within the block form must first be broken. The jackets are configured so that there are three methods of breaking the bond between the block and the jackets.

First, the over-center latches 96 that are used to lock or clamp the two jackets 24 and 26 together can also serve to pry the jackets apart. These latches are off the-shelf ordinary latches used on many concrete forms. Second, the transport 28 may be coupled to the securing rod 88 and the handle of the rod 88 pulled backward and away from the block form 20 to provide lateral force to break the bond. Third, if all else fails, a pry tool (not shown) can be inserted with the pry channels 102 located along each end of the jackets to pry the jackets apart and break the bond. The block form 20 configuration permits the operator to attempt to break the bond from several different directions thereby increasing the likelihood that the bond will be broken without damage to the block form 20 or the block 10.

Once the bond is broken, the jackets can be removed. In removing the jackets from the base pallet, the transport is lifted and coupled to the first jacket 24, for example, by engaging the slots 150 of the lower brackets 148 with the securing rod 88. In this arrangement, the transport is attached to the first jacket only at the bottom of the jacket. The operator then pulls back on the handle 122 of the transport 28 to pivot the transport 28 away from the block form 22.

Figure 7:
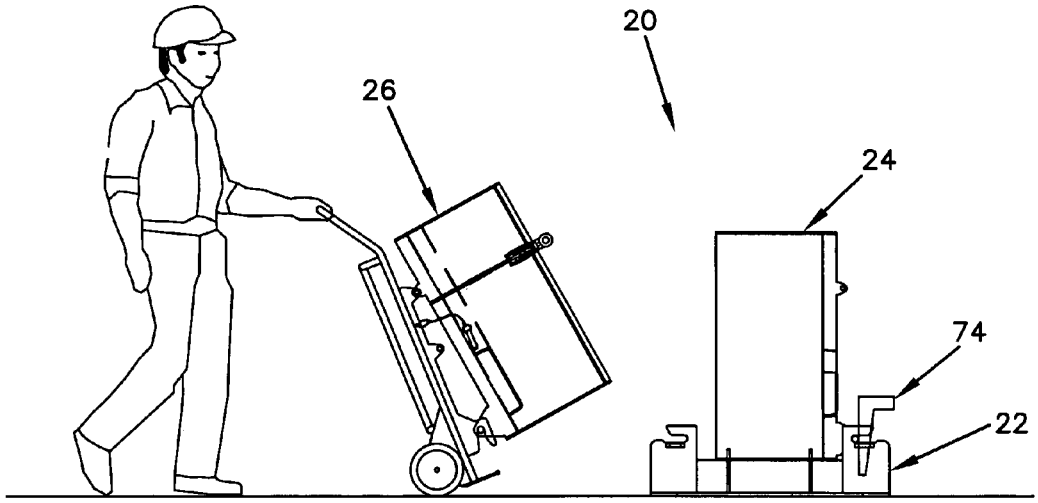
FIG. 7 is a side elevational view of the block forming apparatus of FIG. 3 illustrating movement of a jacket component.
Figure 22:
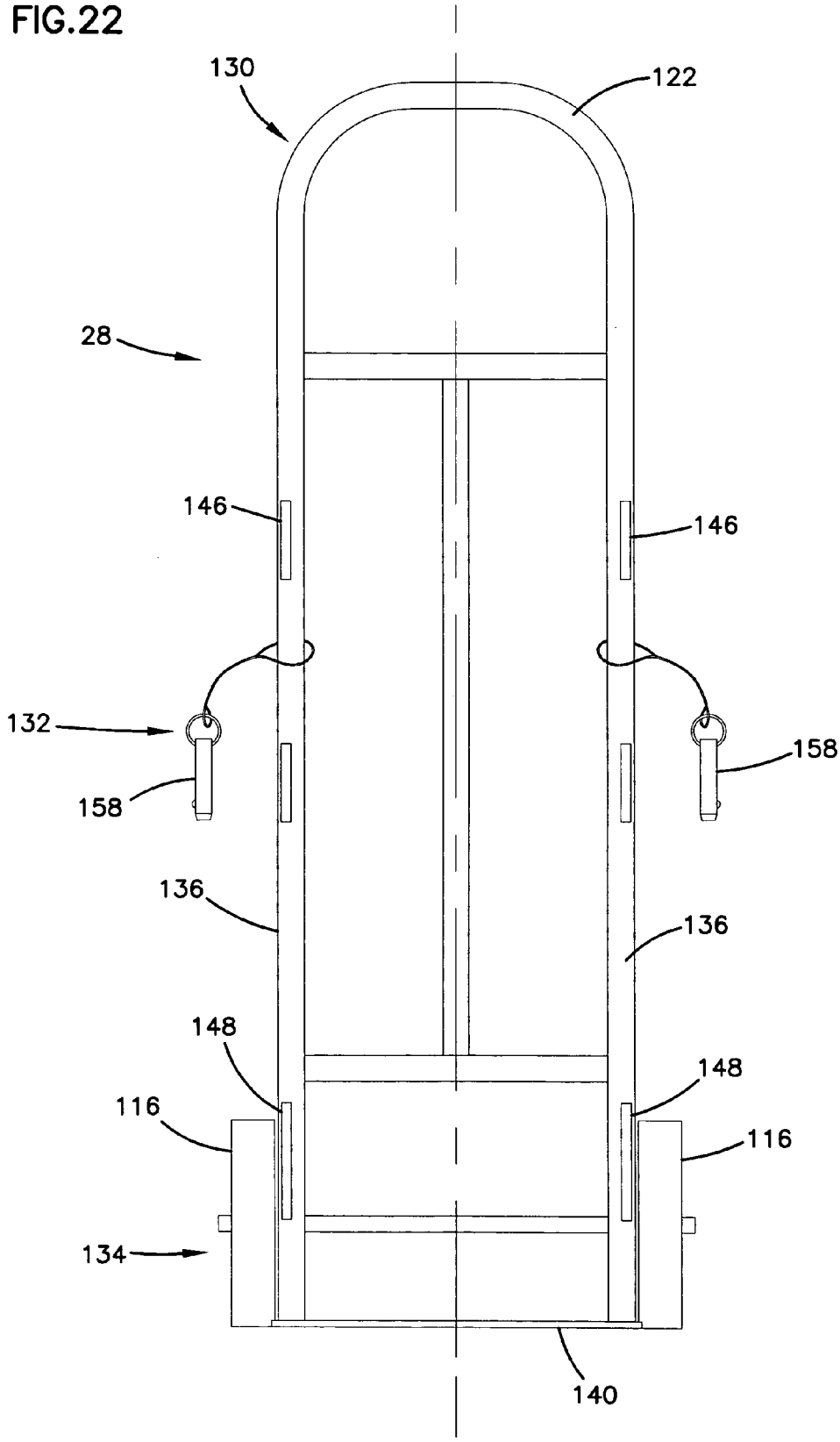
FIG. 22 is a front elevational view of the jacket transport shown in FIG. 20.
Figure 23:
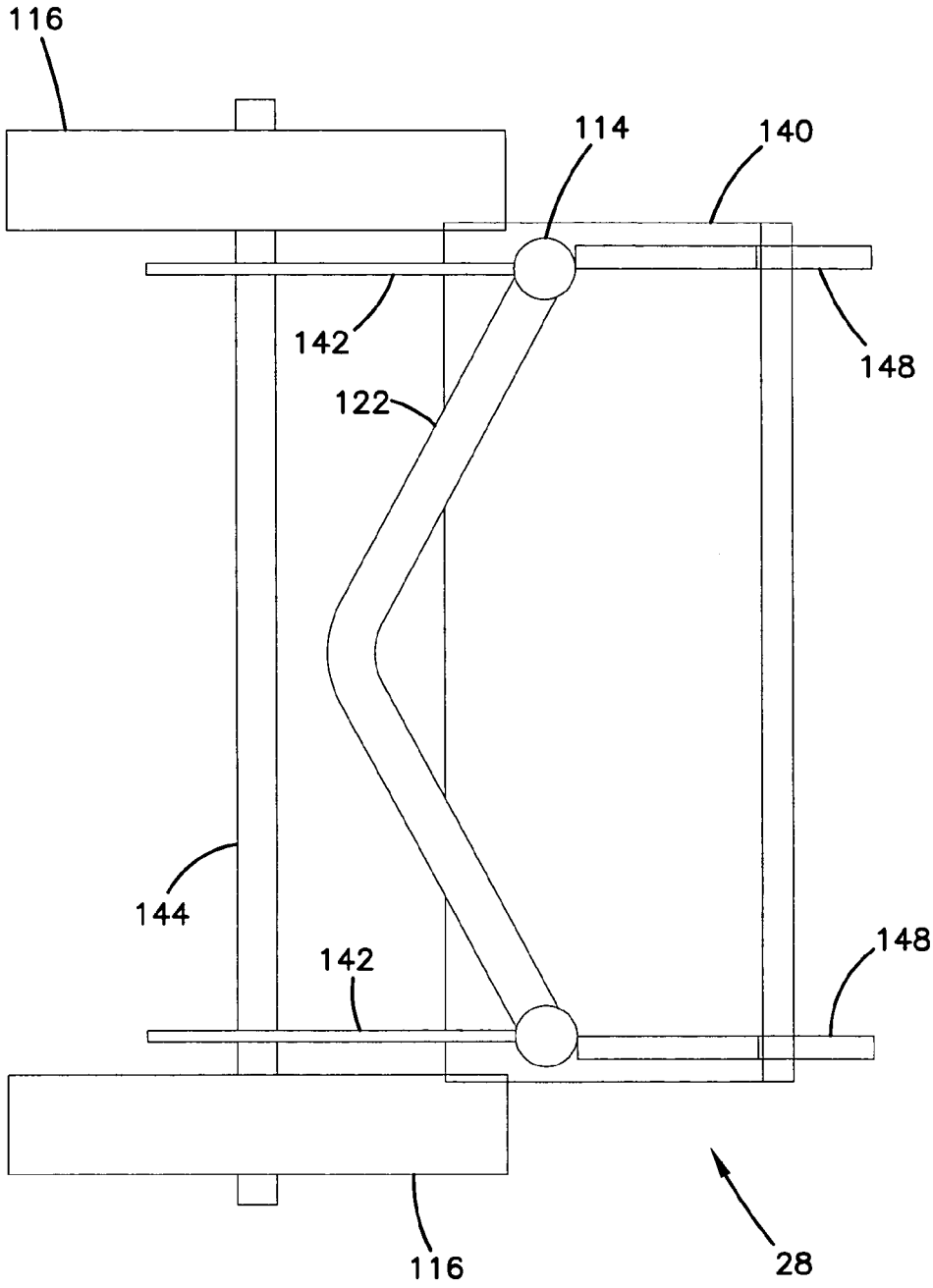
FIG. 23 is a top plan view of the jacket transport shown in FIG. 22.
Figure 24:
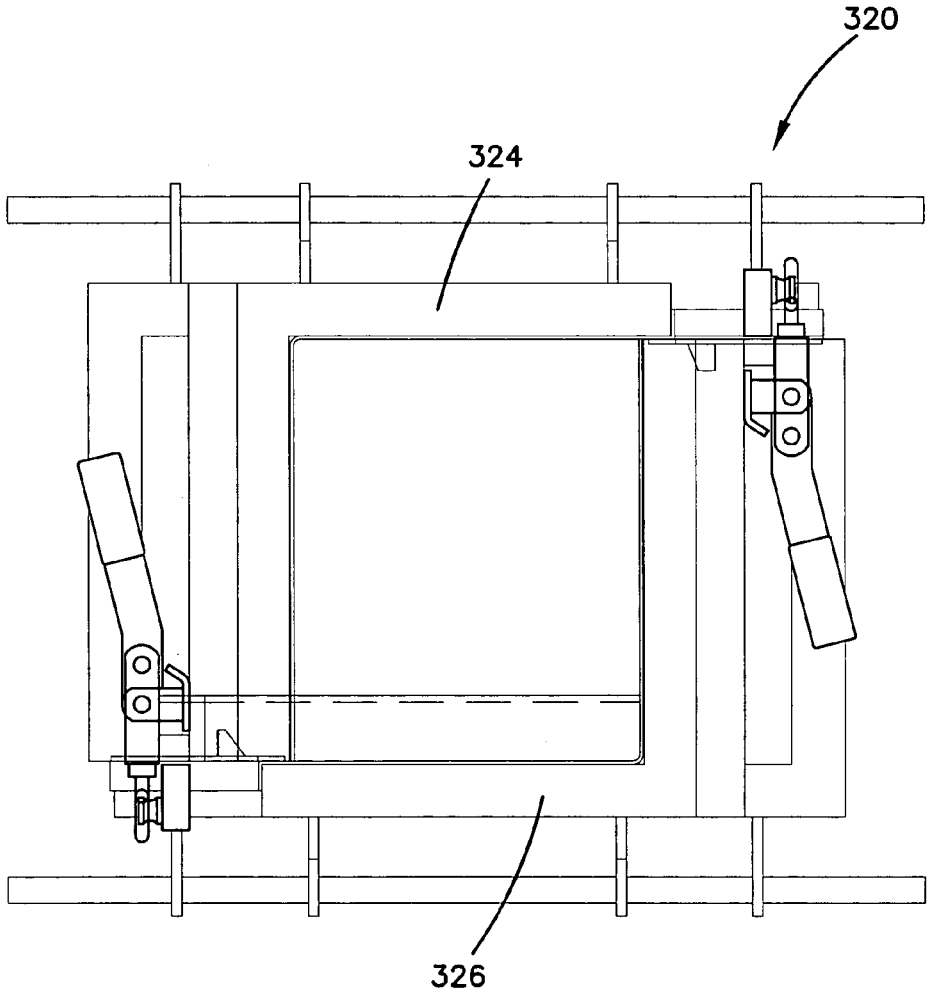
FIG. 24 is a top plan view of another embodiment of jacket components of another block forming apparatus for manufacturing half blocks according to the principles disclosed.
Figure 25:
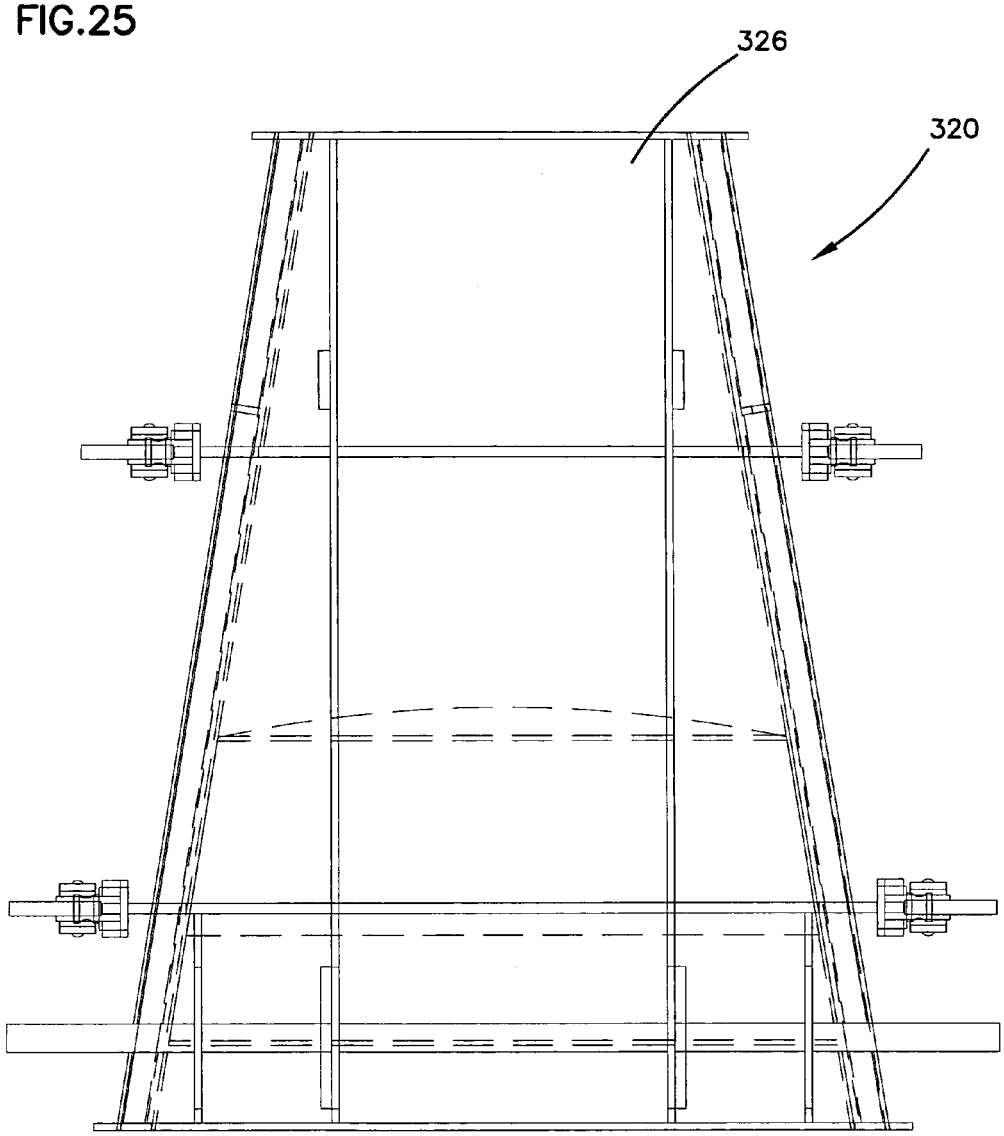
FIG. 25 is a front elevational view of the jacket components of FIG. 24.
Figure 26:
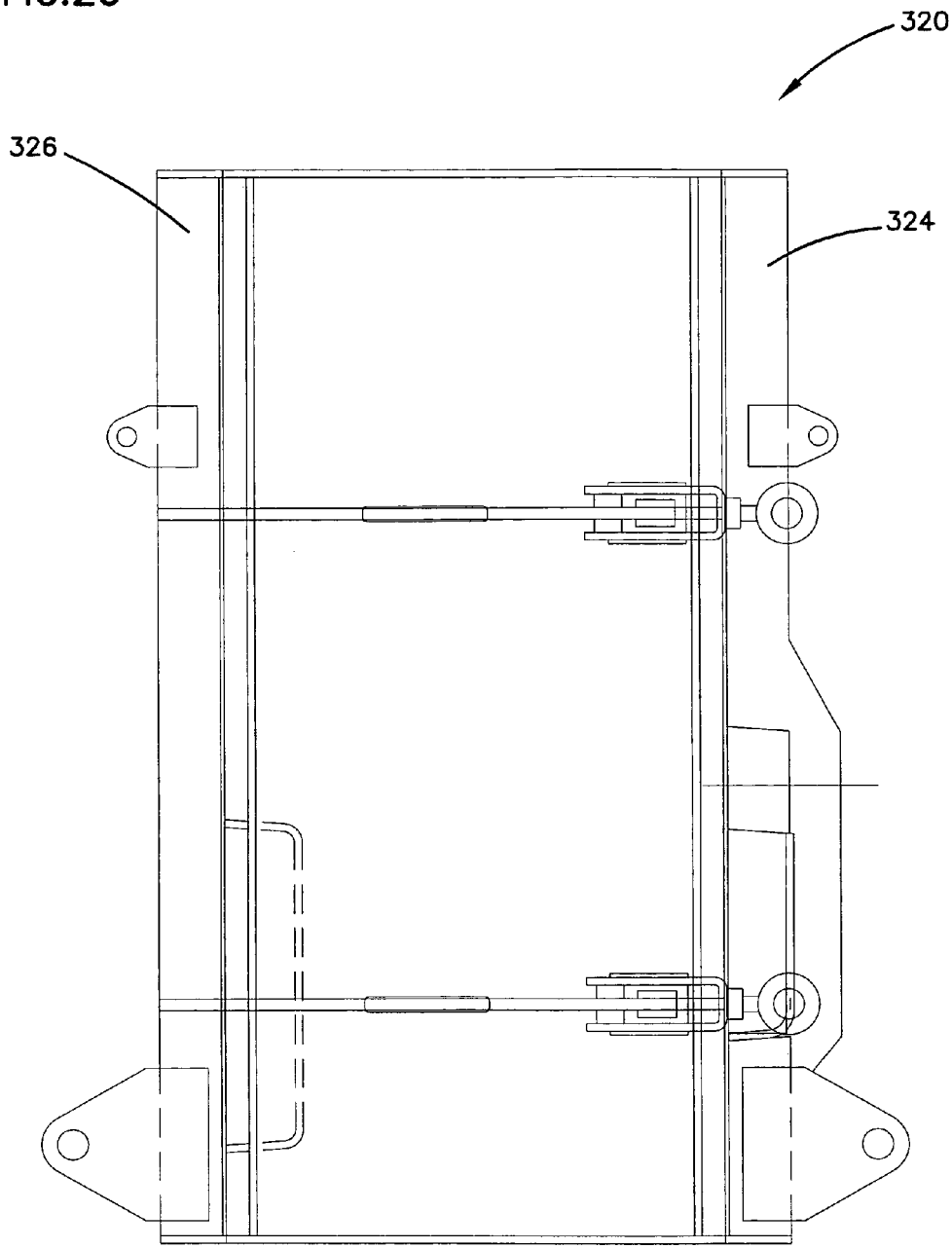
FIG. 26 is a side elevational view of the jacket components of FIG. 25.
Figure 27:
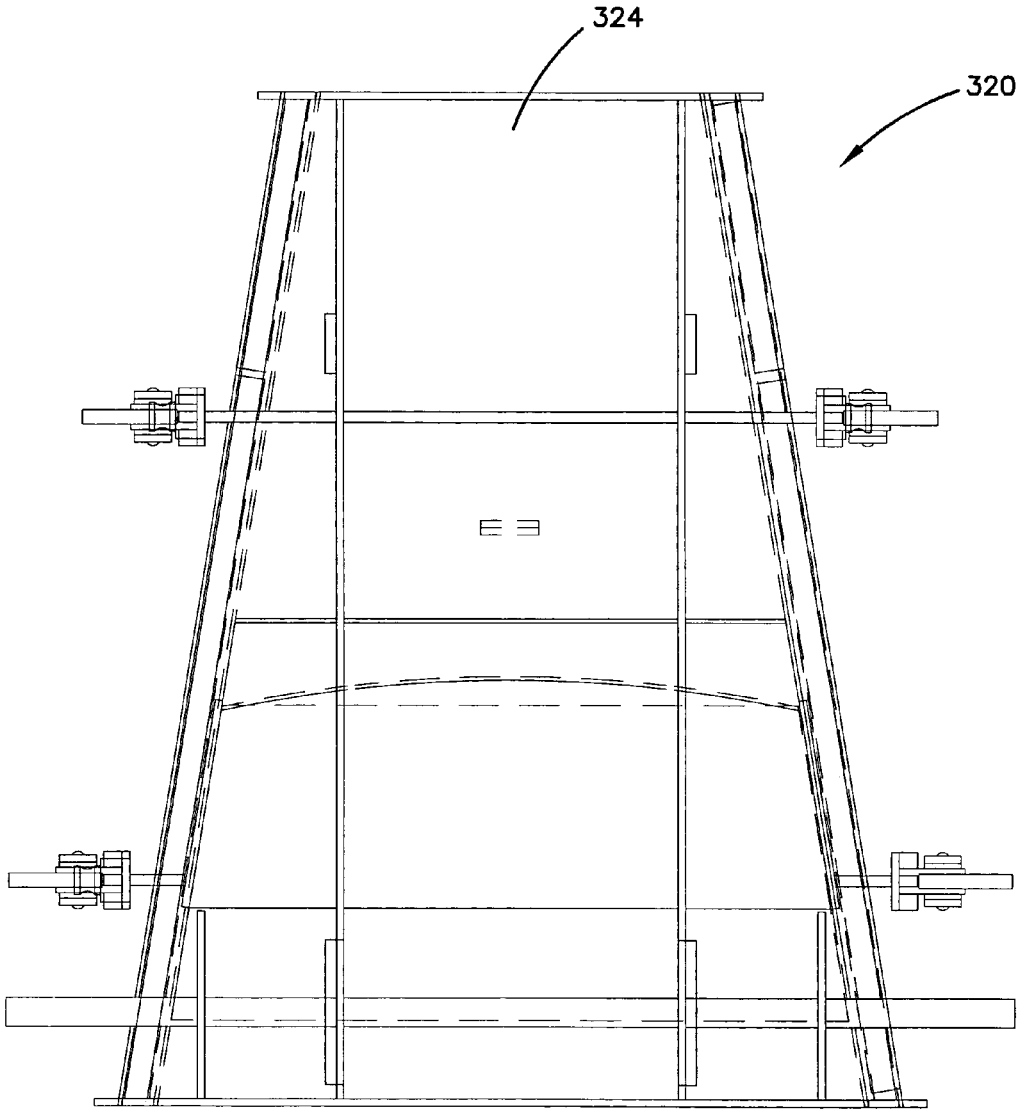
FIG. 27 is a rear elevational view of the jacket components of FIG. 26.

When the transport is coupled to the jacket at only the securing rod and pulled backward, the nose plate 140 functions as a fulcrum point. That is, the transport pivots downward until the wheels 116 contact the ground surface. As the transport 28 is pivoting, the hook portions 152 retain the rod 88 of the jacket to laterally pull or slide the jacket straight back without tilting or rotating of the jacket. This is advantageous in that the jacket pulls straight back and avoids tipping or slipping off the block form 20 or block 10 to damage the tongue or groove sections of the concrete block 10. This also does not bind the jacket against the tongue and grooves of the concrete block. Once the jacket is laterally slid backward about three inches and the tongue and groove sections of the block have been cleared, the transport 28 can be tilted forward toward the jacket and attached to the jacket at the upper brackets 146. As shown in FIG. 22, the pins 158 couple with the brackets 76 of the jacket 24, 26. With the transport 28 attached to both the upper and lower regions 78, 84 of the jacket, the operator can tip the transport backwards and the top portion of the jacket will rotate back with the transport and not bind against the tongue or groove section of the block (see FIGS. 5, 7 and 8). The operator may now move the jacket on the wheels of the transport to another base pallet.

Figure 8:
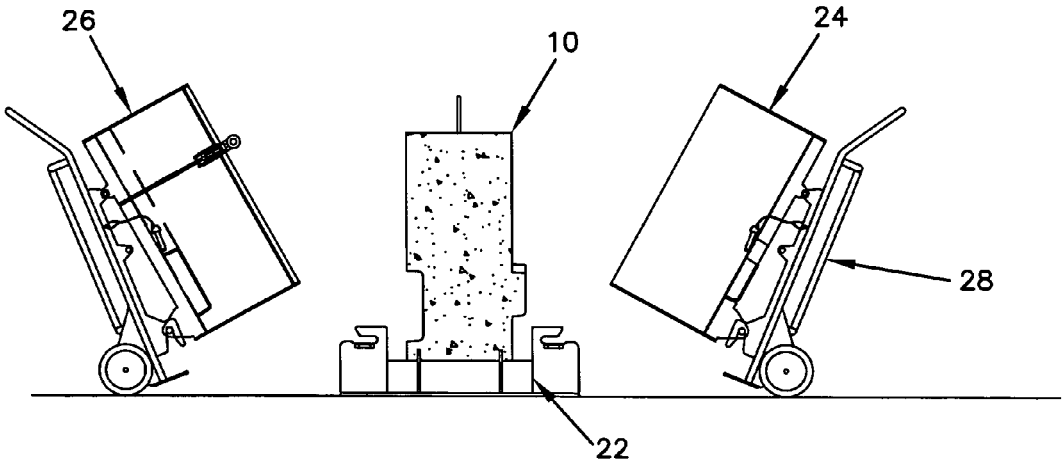
FIG. 8 is a side elevational view of the block forming apparatus of FIG. 3 with both jacket components removed and including the full block shown in FIGS. 1 and 2.

As shown in FIG. 8, the partially cured block may remain standing within the base pallet and the liner until it is fully cured. In the meantime, the jackets can be moved to a second empty base pallet, mounted, and a second block can be poured. Three to four hours later the jackets can be removed from the second base pallet and placed on a third base pallet. When the blocks are fully cured, they may be lifted from the base pallets and liners and stored. By this method, three blocks can be made in nine to twelve hours, requiring only three base pallets and a pair of block form jackets, for example.

Figure 28:
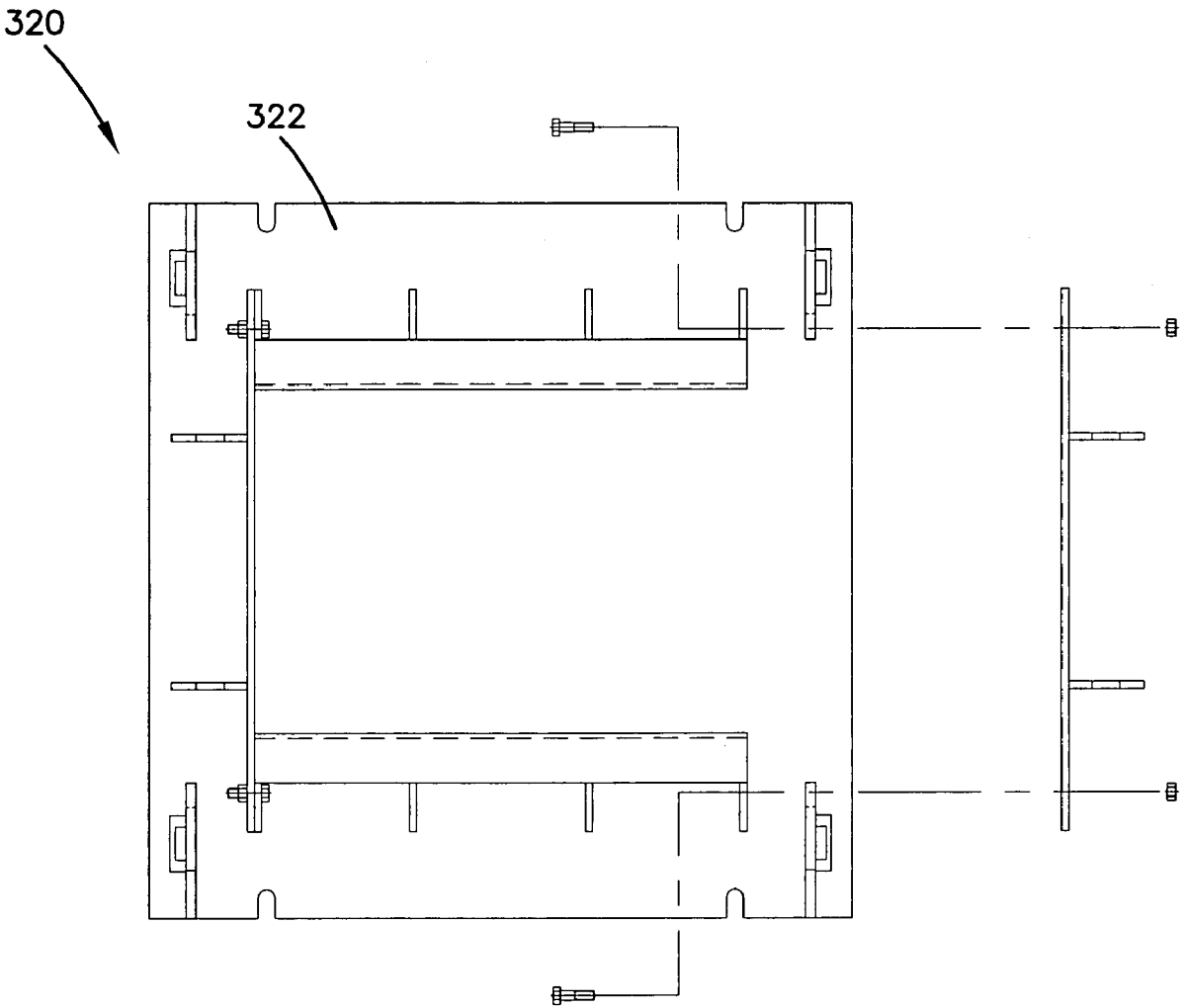
FIG. 28 is a top plan view of another embodiment of a base support that can be used with the jacket components of FIG. 24, according to the principles disclosed.
Figure 29:
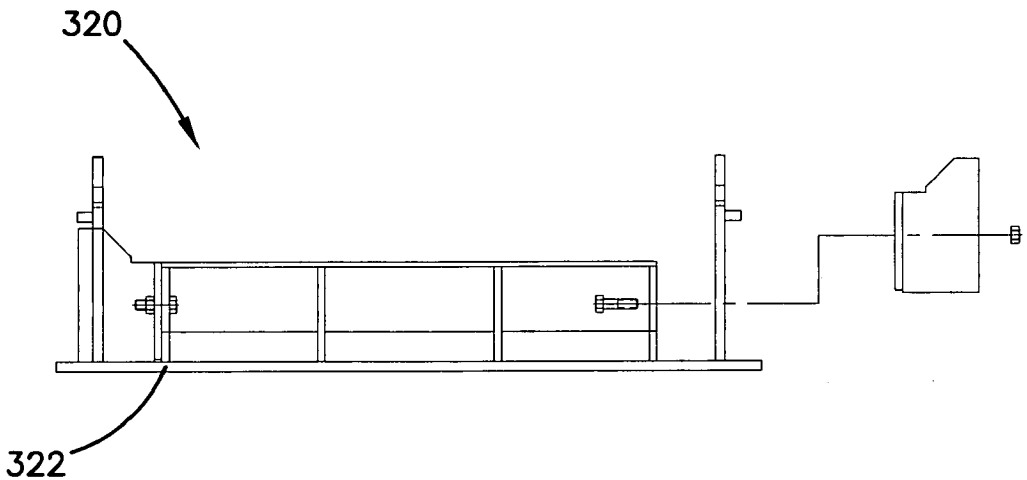
FIG. 29 is a front elevational view of the base support of FIG. 28.
Figure 30:
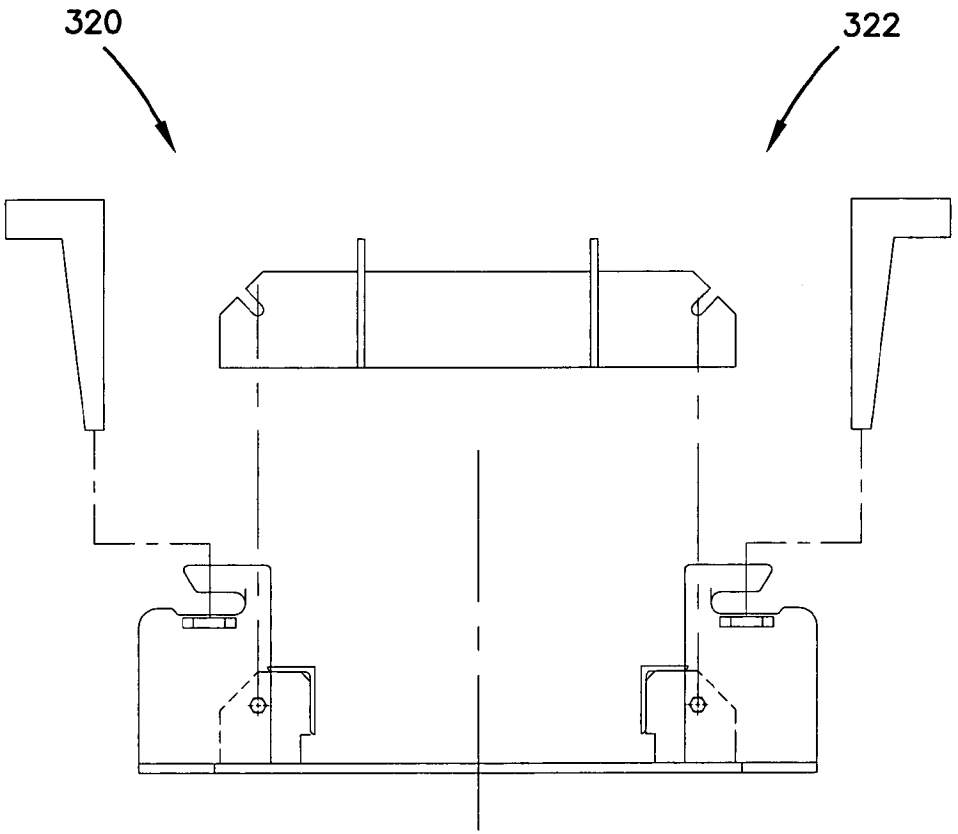
FIG. 30 is an exploded side elevational view of the base support of FIG. 29.

Referring now to FIGS. 24-27, first and second jackets 324 and 326 of a half block form 320 is illustrated. The half block form 320 is similar to the full block form 20 except that the sides are half the width of the full block form. A base support 322 of the half block form (shown in FIGS. 28-30) is accordingly sized and configured. The half block form 320 illustrates an alternative embodiment according to the principles disclosed. Likewise top block pieces and other corner block pieces can be made using jacket and block form embodiments with different configurations in accordance with the principles disclosed.

The above specification, examples and data provide a complete description of the Block Forming Apparatus and Method. Since many embodiments of the invention can be made without departing from the spirit and scope of the invention, the invention resides in the claims hereinafter appended.

What is claimed is:

1. A method of molding concrete blocks, the method comprising the steps of:

(a) providing a block form, the block form including:

(i) a base support having first and second retaining structures, each of the first and second retaining structures including open-ended slots;

(ii) a liner sized for receipt within the base support;

(iii) first and second jackets adapted to detachably couple to the base support; each of the first and second jackets including a securing rod having first and second ends; and (iv) first and second upper locking mechanisms and first and second lower locking mechanisms, the first and second upper locking mechanisms and the first and second lower locking mechanisms being separate from the securing rod;

(b) positioning the liner within the base support;

(c) detachably securing the first jacket to the base support by positioning the first and second ends of the securing rod of the first jacket within the open-ended slots of the first retaining structures of the base support;

(d) detachably securing the second jacket to the base support by positioning the first and second ends of the securing rod of the second jacket within the open-ended slots of the second retaining structures of the base support; the first and second jackets and the liner forming a molding cavity;

(e) securing upper regions of the first and second jackets in position by engaging the upper locking mechanisms;

(f) securing lower regions of the first and second jackets in position by engaging the lower locking mechanisms;

(g) pouring moldable concrete into the molding cavity;

(h) allowing the moldable concrete to only partially cure; and (i) removing the first and second jackets from the only partially cured concrete.

2. The method of claim 1, further including providing a transport device, wherein the step of removing each of the first and second jackets includes attaching the transport device to a first attachment location of the jacket and laterally sliding the jacket from the respective retaining structures relative to the base support.

3. The method of claim 2, wherein the step of removing each of the first and second jackets further includes attaching the transport device to a second attachment location of the jacket after laterally sliding the jacket relative to the base support, tilting the jacket to rest upon the transport, and removing the jacket from the base support.

4. The method of claim 3, wherein the base support is located at a first location, the method further including providing a second base support located at a second location, transporting each of the first and second jackets to the second base support at the second location, and attaching the first and second jackets to the second base support to manufacture a second concrete block.

5. The method of claim 1, wherein engaging the first and second upper locking mechanisms and engaging the first and second lower locking mechanisms include locking over-center clamping devices.

6. The method of claim 1, wherein engaging the first and second upper locking mechanisms includes locking over-center clamping devices, and wherein engaging the first and second lower locking mechanisms includes inserting wedges within wedge brackets located adjacent the first and second retaining structures.

7. The method of claim 1, wherein removing the first and second jackets includes breaking the bond between the partially cured concrete and the jackets.

8. The method of claim 7, wherein the first and second upper locking mechanisms include over-center clamping devices and breaking the bond between the partially cured concrete and the jacket includes ratcheting the over-center clamping devices of the block form to release the lock between the first and second jackets.

9. The method of claim 7, wherein breaking the bond between the partially cured concrete and the jacket includes prying the first and second jackets apart at pry locations located along an edge of the first and second jackets.

10. The method of claim 7, further including providing a transport device, wherein breaking the bond between the partially cured concrete and the jacket includes attaching the transport device to one of first and second attachment locations and moving the transport device to break the bond between the partially cured concrete and the respective first and second jacket.

11. A method of molding concrete blocks, the method comprising the steps of:

(a) providing a block form, the block form including:

(i) a base support having first and second retaining structures, each of the first and second retaining structures including open-ended slots;

(ii) a liner sized for receipt within the base support;

(iii) first and second jackets adapted to detachably couple to the base support; each of the first and second jackets including a securing rod having first and second ends; and (iv) first and second upper locking mechanisms and first and second lower locking mechanisms;

(b) positioning the liner within the base support;

(c) detachably securing the first jacket to the base support by positioning the first and second ends of the securing rod of the first jacket within the open-ended slots of the first retaining structures of the base support;

(d) detachably securing the second jacket to the base support by positioning the first and second ends of the securing rod of the second jacket within the open-ended slots of the second retaining structures of the base support; the first and second jackets and the liner forming a molding cavity;

(e) securing upper regions of the first and second jackets in position by engaging the upper locking mechanisms;

(f) securing lower regions of the first and second jackets in position by engaging the lower locking mechanisms; wherein engaging the first and second upper locking mechanisms and engaging the first and second lower locking mechanisms include locking over-center clamping devices;

(g) pouring moldable concrete into the molding cavity;

(h) allowing the moldable concrete to only partially cure; and (i) removing the first and second jackets from the only partially cured concrete.

* * * * *